US012297825B2

(12) United States Patent
Fowler et al.

(10) Patent No.: US 12,297,825 B2
(45) Date of Patent: May 13, 2025

(54) EXPANDABLE, INNER LINER PUMP

(71) Applicant: Viking Pump, Inc., Cedar Falls, IA (US)

(72) Inventors: David Fowler, Pevensey (GB); Michael Strei, Cedar Falls, IA (US); Sven Schimmel, Reckendorf (DE); Max Portocarrero, Chicago, IL (US)

(73) Assignee: Viking Pump, Inc., Cedar Falls, IA (US)

( * ) Notice: Subject to any disclaimer, the term of this patent is extended or adjusted under 35 U.S.C. 154(b) by 9 days.

(21) Appl. No.: 18/300,847

(22) Filed: Apr. 14, 2023

(65) Prior Publication Data

US 2023/0332593 A1 Oct. 19, 2023

Related U.S. Application Data

(60) Provisional application No. 63/330,855, filed on Apr. 14, 2022.

(51) Int. Cl.
*F04B 49/22* (2006.01)
*F04B 23/04* (2006.01)
(Continued)

(52) U.S. Cl.
CPC ..... *F04B 49/22* (2013.01); *F04B 23/04* (2013.01); *F04B 43/08* (2013.01); *F04B 43/1136* (2013.01)

(58) Field of Classification Search
CPC .. F04B 43/084; F04B 43/086; F04B 43/0072; F04B 43/107; F04B 43/1136; F04B 23/04
(Continued)

(56) References Cited

U.S. PATENT DOCUMENTS 1,832,257 A 11/1931 Stephens
3,007,416 A 11/1961 Childs
(Continued)

FOREIGN PATENT DOCUMENTS

CN 102758754 A 10/2012
DE 3443768 C2 6/1992
(Continued)

OTHER PUBLICATIONS

"Multisafe Double Hose-Diaphragm Pumps for abrasive, aggressive and toxic media," FELUWA, 28 pages, Germany.
(Continued)

*Primary Examiner* — Kenneth J Hansen
(74) *Attorney, Agent, or Firm* — Tucker Ellis LLP; Michael G. Craig; Anna Nelson

(57) ABSTRACT

Provided is a pump system that includes a primary pump and a secondary pump. The primary pump pumps a primary fluid. A first pump unit of the primary pump includes a first inner liner defining a first primary fluid chamber and also includes a first outer liner disposed around the first inner liner. The interior of the first outer liner defines a secondary fluid chamber. The secondary pump pumps a secondary fluid and is in fluid communication with the first secondary fluid chamber to operably pump the secondary fluid into and out of the first secondary fluid chamber, resulting in the compression and expansion of the first inner liner. A first valve is disposed proximate the primary fluid chamber inlet, and a second valve disposed proximate the primary fluid chamber outlet. The first and second valves allow fluid flow in one direction through the primary fluid chamber.

20 Claims, 24 Drawing Sheets

(51) Int. Cl.
*F04B 43/08* (2006.01)
*F04B 43/113* (2006.01)

(58) Field of Classification Search
USPC ..... 92/25, 37, 38, 96, 103 R
See application file for complete search history.

(56) References Cited

U.S. PATENT DOCUMENTS

| | | | | |
|---|---|---|---|---|
| 3,148,624 | A | 9/1964 | Baldwin | |
| 3,451,347 | A | 6/1969 | Chimura | |
| 3,526,223 | A | 9/1970 | Curtis et al. | |
| 3,860,968 | A | 1/1975 | Shapiro | |
| 3,883,272 | A | 5/1975 | Puckett | |
| 3,951,572 | A | 4/1976 | Ray, Jr. et al. | |
| 3,955,557 | A | 5/1976 | Takagi | |
| 4,250,872 | A | 2/1981 | Tamari | |
| 4,439,112 | A | 3/1984 | Kitsnik | |
| 4,479,762 | A | 10/1984 | Bilstad et al. | |
| 4,501,583 | A | 2/1985 | Troutner | |
| 4,552,552 | A | 11/1985 | Polaschegg et al. | |
| 4,906,229 | A | 3/1990 | Wampler | |
| 4,934,906 | A | 6/1990 | Williams | |
| 5,002,471 | A | 3/1991 | Perlov | |
| 5,213,478 | A | 5/1993 | Hoya | |
| 5,817,001 | A | 10/1998 | Leschinsky et al. | |
| 5,921,951 | A | 7/1999 | Morris | |
| 6,312,409 | B1 | 11/2001 | Gross | |
| 6,419,462 | B1 | 7/2002 | Horie et al. | |
| 6,562,000 | B2 | 5/2003 | Thompson et al. | |
| 6,604,908 | B1 | 8/2003 | Bryant et al. | |
| 6,733,252 | B2 | 5/2004 | Feygin et al. | |
| 6,887,047 | B2 | 5/2005 | Grapes | |
| 6,948,918 | B2 | 9/2005 | Hansen | |
| 7,021,195 | B2 * | 4/2006 | Proust | F02M 37/16 92/92 |
| 7,357,567 | B2 | 4/2008 | Terentiev | |
| 7,384,027 | B2 | 6/2008 | Terentiev et al. | |
| 7,407,490 | B2 | 8/2008 | Bendsen et al. | |
| 7,410,329 | B2 | 8/2008 | Simontacchi | |
| 7,452,166 | B2 | 11/2008 | von Keudell et al. | |
| 7,469,748 | B2 | 12/2008 | Ocalan et al. | |
| 7,481,572 | B2 | 1/2009 | Terentiev | |
| 7,713,239 | B2 | 5/2010 | Uber, III et al. | |
| 7,836,814 | B2 | 11/2010 | Lefebvre | |
| 7,841,842 | B2 | 11/2010 | Yajima | |
| 7,867,198 | B2 | 1/2011 | Yamada et al. | |
| 8,047,814 | B2 | 11/2011 | Yajima | |
| 8,152,476 | B2 | 4/2012 | Babicki et al. | |
| 8,162,903 | B2 | 4/2012 | Reilly et al. | |
| 8,323,007 | B2 | 12/2012 | Butterfield | |
| 8,366,667 | B2 | 2/2013 | Chan et al. | |
| 8,398,858 | B2 | 3/2013 | Kashefi-Khorasani et al. | |
| 8,556,225 | B2 | 10/2013 | Gray | |
| 8,579,859 | B2 | 11/2013 | Kramer et al. | |
| 8,821,442 | B2 | 9/2014 | Haar | |
| 9,180,243 | B2 | 11/2015 | Michaud | |
| 9,636,445 | B2 | 5/2017 | Jonsson et al. | |
| 9,687,599 | B2 | 6/2017 | Gonnelli et al. | |
| 9,707,345 | B2 | 7/2017 | Eggert et al. | |
| 9,850,889 | B2 | 12/2017 | Van De Velde et al. | |
| 9,909,909 | B2 | 3/2018 | Schumacher | |
| 9,919,090 | B2 | 3/2018 | Peters et al. | |
| 10,272,199 | B2 | 4/2019 | Yodfat et al. | |
| 10,525,194 | B2 | 1/2020 | Gonnelli et al. | |
| 10,994,062 | B2 | 5/2021 | Pratt et al. | |
| 11,015,731 | B2 | 5/2021 | Naegel et al. | |
| 11,116,894 | B2 | 9/2021 | Stettner | |
| 11,253,690 | B2 | 2/2022 | Judisch et al. | |
| 11,291,817 | B2 | 4/2022 | Klemm et al. | |
| 11,313,362 | B2 | 4/2022 | Matsuo et al. | |
| 11,364,328 | B2 | 6/2022 | Wyeth et al. | |
| 11,414,642 | B2 | 8/2022 | Stobbe | |
| 11,419,976 | B1 | 8/2022 | Schiff et al. | |
| 11,543,038 | B2 | 1/2023 | Fulkerson et al. | |
| 11,598,328 | B2 | 3/2023 | Algawi et al. | |
| 11,619,218 | B2 | 4/2023 | Di Leo | |
| 2006/0236756 | A1 | 10/2006 | Rinaldi et al. | |
| 2007/0201993 | A1 | 8/2007 | Terentiev et al. | |
| 2009/0053074 | A1 * | 2/2009 | Babicki | F04B 23/106 417/44.9 |
| 2011/0021993 | A1 | 1/2011 | Bar-Haim et al. | |
| 2011/0311374 | A1 | 12/2011 | Ocalan et al. | |
| 2012/0209249 | A1 | 8/2012 | Basso et al. | |
| 2012/0241469 | A1 * | 9/2012 | Takeishi | F04B 9/00 222/1 |
| 2015/0335817 | A1 | 11/2015 | Lambert | |
| 2016/0106903 | A1 | 4/2016 | Nilsson et al. | |
| 2017/0097121 | A1 * | 4/2017 | Johnson | F17C 11/007 |
| 2018/0155667 | A1 | 6/2018 | Stobbe | |
| 2021/0244936 | A1 | 8/2021 | Bark | |
| 2021/0301242 | A1 | 9/2021 | Broadley et al. | |
| 2022/0333059 | A1 | 10/2022 | Stobbe | |
| 2023/0042475 | A1 | 2/2023 | Stobbe | |
| 2023/0056468 | A1 | 2/2023 | Stobbe | |
| 2023/0201434 | A1 | 6/2023 | Weaver et al. | |
| 2023/0203426 | A1 | 6/2023 | Stobbe | |

FOREIGN PATENT DOCUMENTS

| | | | |
|---|---|---|---|
| DE | 4221379 | A1 | 1/1994 |
| DE | 102020105008 | A1 | 8/2021 |
| DE | 202021106223 | U1 | 11/2021 |
| EP | 0191071 | B1 | 4/1990 |
| EP | 0659444 | B1 | 5/1999 |
| EP | 0995483 | A1 | 4/2000 |
| EP | 0957954 | B1 | 5/2003 |
| EP | 1546556 | B1 | 12/2006 |
| EP | 1810706 | A1 | 7/2007 |
| EP | 1450882 | B1 | 2/2008 |
| EP | 2442852 | B1 | 5/2013 |
| EP | 2675573 | B1 | 11/2014 |
| EP | 2512547 | B1 | 5/2015 |
| EP | 2005309 | B1 | 2/2016 |
| EP | 1961436 | B1 | 8/2016 |
| EP | 3338832 | A1 | 6/2018 |
| EP | 2173407 | B1 | 2/2020 |
| EP | 3381489 | B1 | 4/2020 |
| EP | 3585522 | B1 | 3/2021 |
| EP | 3512578 | B1 | 7/2021 |
| EP | 2724736 | B1 | 6/2022 |
| EP | 4126111 | A1 | 2/2023 |
| EP | 4213906 | A1 | 7/2023 |
| FR | 2175274 | A5 | 10/1973 |
| GB | 2379719 | A | 3/2003 |
| NL | 2016463 | B1 | 10/2017 |
| WO | 2000035515 | A1 | 6/2000 |
| WO | 2020222656 | A1 | 11/2020 |

OTHER PUBLICATIONS

"Expert Solution for Biopharma Applications," Quattroflow Fluid Systems, 32 pages, Germany.

"Revolutionizing Single-Use-Pump," PumpCell, Dec. 2017, 17 pages, Retrieved from the Internet <https://pumpcell.com/media/11266/pumpcell-presentation-2017-ver-1.pdf>.

The International Search Report and The Written Opinion of the International Searching Authority from related PCT Application No. PCT/US2023/018645, Date of Mailing Jul. 20, 2023, 13 pages.

* cited by examiner

EXPANDABLE, INNER LINER PUMP

RELATED APPLICATIONS

This application claims priority to U.S. Provisional Application Ser. No. 63/330,855 filed on Apr. 14, 2022, which is incorporated herein by reference in its entirety.

BACKGROUND

Pumps are used in many processes that support the production of biopharmaceuticals. Pumps selected for these applications are designed specifically to handle fluids containing biological structures with high efficiency, low rates of shear, and minimal turbulence of the internal flow regime. All of these mechanisms have the potential to damage structures like cells, proteins, or similar delicate structures. These materials can be costly to produce, and thus, pumps that exhibit characteristics of "gentle pumping action" and have high yield rates are preferred. Positive displacement pumps can be used to transfer sensitive fluids that are prone to damage. Positive displacement pumps can often be of the rotary type or the reciprocating type. For example, a common hygienic positive replacement pump is the rotary lobe pump, which utilizes two or more lobes that rotate around parallel shafts to move a liquid with reduced damage to the product.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

Provided herein is an innovative pump system that can move fluids using a gentle action that mitigates damage to components entrained in the fluid, such as biologicals, biopharmaceuticals, and other potential fragile elements. In one implementation, the pump system has a primary pump operably coupled to a secondary pump. The primary pump comprises an inner liner within an outer liner, such as a rigid or semi-rigid housing. Inner surfaces of the inner liner define a primary fluid chamber that pumps the primary fluid. The secondary pump provides a secondary fluid to a secondary fluid chamber defined by outer surfaces of the inner liner and inner surfaces of the outer liner. When the secondary fluid is pumped out of the secondary fluid chamber, the inner liner expands to draw a primary fluid into the primary fluid chamber defined by the inner liner. When the secondary fluid is pumped into the secondary fluid chamber, the inner liner compresses to expel the primary fluid from the primary fluid chamber. In this way, the primary fluid can be operably pumped through the cell(s) without contacting any of the pumping systems.

In another implementation, the pump system comprises a pump system that includes a primary pump, a secondary pump, and first and second valves. The primary pump pumps a primary fluid and comprises a first pump unit. The first pump unit includes a first inner liner, wherein an interior of the first inner liner defines a first primary fluid chamber. The first primary fluid chamber comprises an inlet and an outlet. The first pump unit further includes a first outer liner that is disposed around the first inner liner. An interior of the first outer liner defines at least a portion of a first secondary fluid chamber. The secondary pump pumps a secondary fluid and is in fluid communication with the first secondary fluid chamber to operably pump the secondary fluid into and out of the first secondary fluid chamber. This pumping of the secondary fluid by the secondary pump results in the compression and expansion of the first inner liner. The first valve is disposed proximate the primary fluid chamber inlet, and the second valve is disposed proximate the primary fluid chamber outlet. The first and second valves in combination are configured to merely allow fluid flow in one direction through the primary fluid chamber.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

BRIEF DESCRIPTION OF THE DRAWINGS

What is disclosed herein may take physical form in certain parts and arrangement of parts, and will be described in detail in this specification and illustrated in the accompany drawings which form a part hereof and wherein.

DETAILED DESCRIPTION

Figure 1:
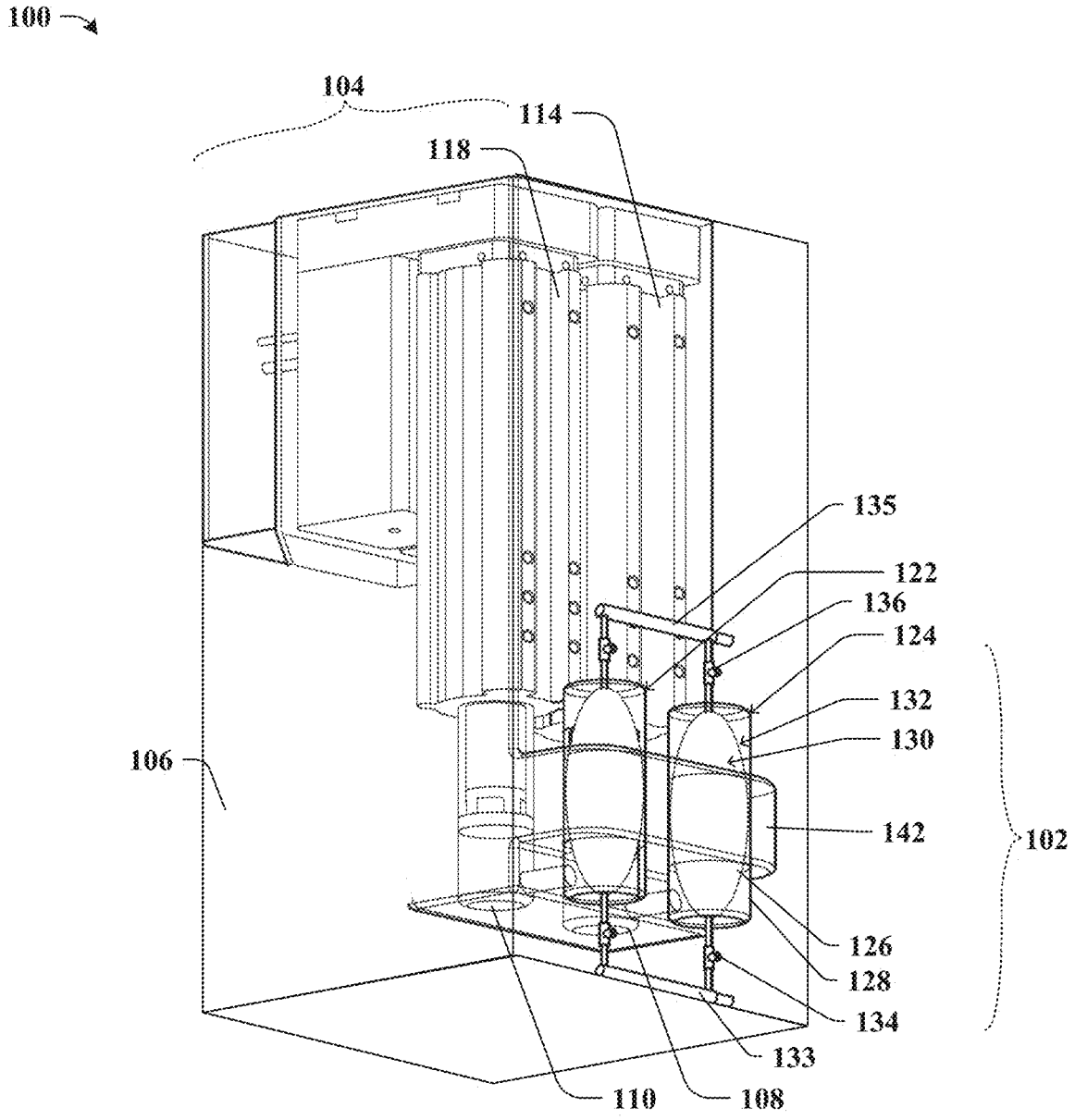
FIG. 1 illustrates a perspective view of some implementations of a pump system comprising an inner, expandable liner as described herein.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

Some fluids and components entrained therein may be sensitive to damage, such as from pressure, crushing, etc., and may require a more gentle fluid handling compared to other fluids. For example, a biological fluid may be entrained with component or particles that can be damaged during pumping, such as blood cells in whole blood, proteins, virus, crystals in a mixture, biologicals, biopharmaceuticals, etc. To help mitigate damage during pumping, a hygienic positive displacement pump can be provided that reduces damage to entrained particles and provides for desired pressure and flow rate delivery.

As an example, a common positive displacement pump is a rotary lobe pump, which can provide for appropriate fluid flow rate and pressure handling for sensitive fluids. The rotary lobe pump, however, can be inefficient at low flows, can be difficult to maintain and repair, and may have multiple rotors and rotating shafts, which provides complexity. Additionally, the rotary lobe pump may cause damage to entrained particles in a fluid due to pressure gradients across low clearance features that may produce high rates of shear, high turbulence, and flow extension effects. Another positive displacement pump is a peristaltic pump, which may damage entrained particles due to a high sheer potential. Further, quaternary diaphragm pumps, which comprise a series of diaphragms with check valves, use mechanical linkage or fluidic means to operate the diaphragms. Small displacement and fast action of the pumping elements and associated valves may not provide a gentle enough action, as the flow in and out of the diaphragm can provide high sheer and turbulence around the valves.

Therefore, it may be desirable to provide a pump with gentle fluid handling that provides desired fluid flow rates, volumes, and pressures through straight flow paths delivering potential for laminar flows while also increasing internal clearances to reduce shear rate effects. Further, it is desirable to provide a pump type that is easier to maintain and use than the current pumps on the market. For example, it is desirable to provide a pump that may have disposable portions that may be replaced without contamination for hygienic purposes.

Figure 2:
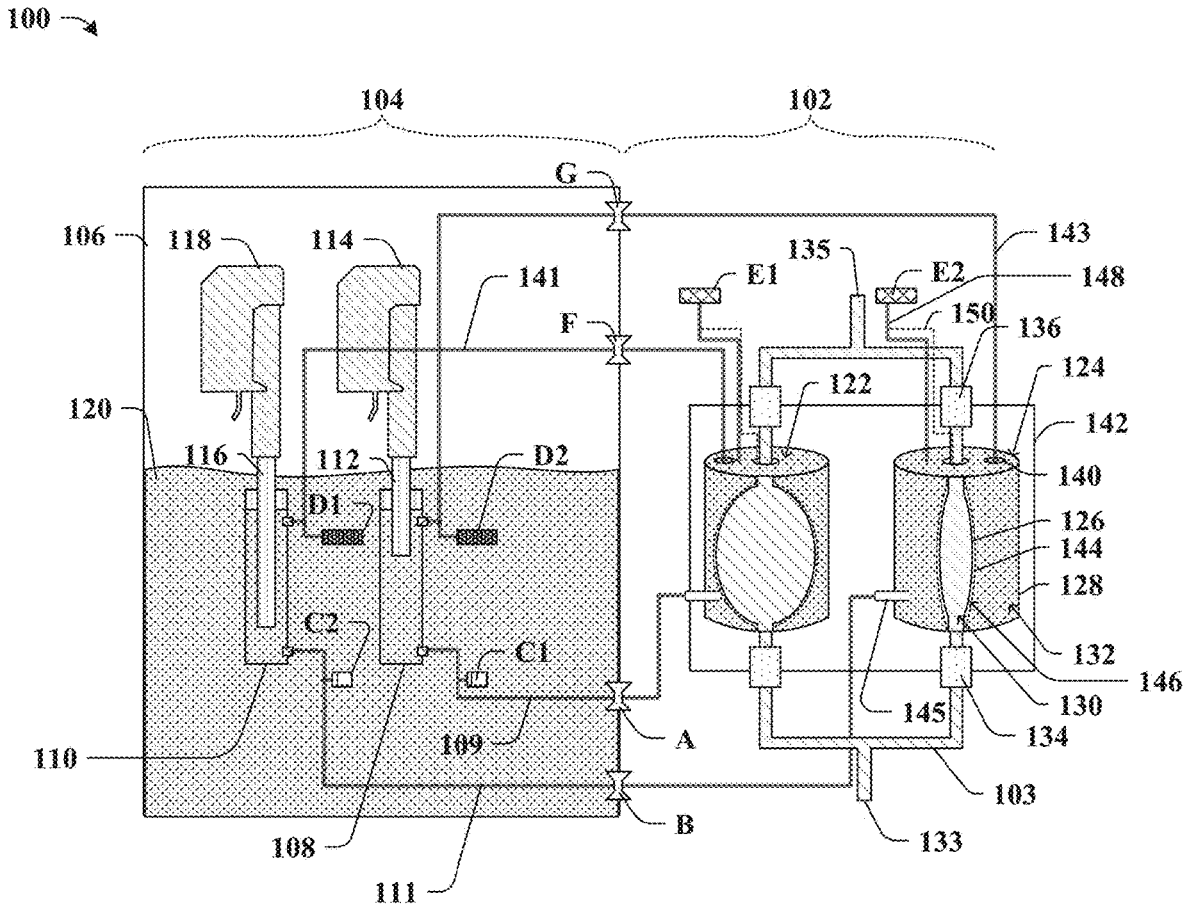
FIG. 2 illustrates a cross-sectional view of some implementations of a pump system comprising an inner, expandable liner as described herein.

FIGS. 1 and 2 will be described together. FIG. 1 illustrates a perspective view of some implementations of an exemplary pump system 100 comprising an inner liner that is expandable for gentle fluid handling, and FIG. 2 illustrates a cross-sectional schematic view of some implementations of an exemplary pump system 100. It will be appreciated that FIG. 1 illustrates one of many examples of a pump system 100 disclosed herein, and thus, the arrangement and sizing of features in the pump system 100 shown in FIG. 1 are not limiting.

The exemplary pump system 100 comprises a primary pump 102 operably coupled to a secondary pump 104. The primary pump 102 comprises a first pump unit 122 and a second pump unit 124. Each of the first pump unit 122 and the second pump unit 124 comprise an inner liner 126 arranged within an outer liner 128. The outer liner 128 may be a rigid housing, a semi-rigid housing, or some outer suitable surrounding structure. In some implementations, the outer liner 128 is less flexible than the inner liner 126. In some implementations, the first and second pump units 122, 124 are supported by a primary housing 142, which is operably coupled to the secondary pump 104. The primary pump 102 is configured to transport a primary fluid 103 between a primary fluid inlet 133 and a primary fluid outlet 135 for a pumping process. The primary fluid 103 travels through a primary fluid chamber 130 of each pump unit 122, 124. The primary fluid chamber 130 is defined by inner surfaces of the inner liner 126. In some implementations, the first and second pump units 122, 124 are arranged in parallel between the primary fluid inlet and outlet 133, 135. This way, the first and second pump units 122, 124 can operably pump in a synchronous and phased operation with respect to one another.

The secondary pump 104 comprises and is in fluid communication with a secondary fluid sump 106 configured to house a secondary fluid 120 for the secondary pump 104. The secondary fluid 120 may comprise water, an oil, or some other suitable pumping fluid, such as a non-compressible fluid. The secondary pump 104 provides the secondary fluid 120 to a secondary fluid chamber 132 of each of the first and second pump units 122, 124 of the primary pump 102. The secondary fluid chambers 132 of the primary pump 102 are defined by inner surfaces of each outer liner 128 and outer surfaces of each inner liner 126. In some implementations, a first piston chamber 108 and a second piston chamber 110 of the secondary pump 104 are partially or fully submerged within the secondary fluid 120 in the secondary fluid sump 106. In some other implementations, the first and/or second piston chambers 108, 110 of the secondary pump 104 are not submerged within the secondary fluid 120 of the secondary fluid sump 106. In some such other implementations, for example, the first and second piston chambers 108, 110 are arranged outside of the secondary fluid sump 106 but are fluidly coupled to the secondary fluid sump 106 via valving and tubing. Similarly, the primary pump 102 may be arranged above, below, or further away from the secondary pump 104 as illustrated in order to accommodate sizing constraints in the surrounding environment of the pump system 100. Such alternative arrangements can be easily made by adjusting the length of tubing that connects the primary pump 102 to the secondary pump 104.

The first and second piston chambers 108, 110 are configured to house some of the secondary fluid 120. A first piston 112 is operably coupled to the first piston chamber 108, and a first actuator 114 is operably coupled to the first piston 112 to control the position of the first piston 112 in the first piston chamber 108. The first actuator 114 and first piston 112 control, at least in part, the amount of secondary fluid 120 in the first piston chamber 108 to facilitate pumping of the secondary fluid 120. Similarly, a second piston 116 is operably coupled to the second piston chamber 110, and a second actuator 118 is operably coupled to the second piston 116 to control the position of the second piston 116 in the second piston chamber 110. The second actuator 118 and second piston 116 control, at least in part, the amount of secondary fluid 120 in the second piston chamber 110 to facilitate pumping of the secondary fluid 120.

The inner liner 126 comprises a flexible material configured to expand and contract upon pressure changes within the primary and/or secondary fluid chambers 130, 132 to perform the target pumping operation and maintain integrity for a target number of cycles or time. The secondary fluid 120 surrounds the inner liner 126 in the secondary fluid chamber 132, and the primary fluid 103 is contained within the inner liner 126 in the primary fluid chamber 130. When the secondary pump 104 pumps the secondary fluid 120 into one of the secondary fluid chambers 132, then the inner liner 126 surrounded by that secondary fluid chamber 132 is compressed and expels the primary fluid 103 from the primary fluid chamber 130 and towards the primary fluid outlet 135. When the secondary pump 104 draws the secondary fluid 120 out of one of the secondary fluid chambers 132, then the inner liner 126 surrounded by that secondary fluid chamber 132 can expand and draw primary fluid 103 into the primary fluid chamber 130 from the primary fluid inlet 133. In this way, the primary fluid 103 can be operably pumped through the primary pump 102 in a same direction without contacting the secondary fluid 120. Thus, the inner liner 126 fluidly seals the primary fluid 103 from the secondary fluid 120.

In some implementations, the primary fluid 103 comprises a biological, biopharmaceutical, or other fluid that is a good candidate for a gentle pumping action. Such primary fluids 103 may be entrained with particles that can be damaged during pumping, such as blood cells in whole blood, proteins, virus, crystals in a mixture, biologicals, biopharmaceuticals, or some other similar delicate particle. The flexibility of the inner liners 126 reduces harsh contact and thus, damage to the entrained particles during pumping. The inner liners 126 are controlled by the secondary fluid 120 which also provides for a gentler and more accurate handling of the primary fluid 103.

Further contributing to gentle handling of the primary fluid 103, the various pump systems 100 described herein can provide best in class flow regimes to support stable transport of biological structures. This type of pump system 100 can also provide best in class metering capability for biological applications. That is, for example, having a known volume of secondary fluid 120 pumped, and a known rate of pumping that secondary fluid 120, translates into a known pumped volume and flow rate of the primary fluid 103. Therefore, in this example, such a pump may eliminate the need for a separate meter or flow sensor. Further, the disclosed pump system 100 may gently pump a relatively large volume of primary fluid 103 for a pump system of such small physical dimensions and low operating speed. For example, in some implementations, the inner liner 126 used in the pump system 100 may have a length and a width in a range of between, for example, approximately 50 millimeters and approximately 150 millimeters. In some other implementations, the inner liner 126 may have a length and a width in a range of between, for example, approximately 100 millimeters and approximately 200 millimeters. Further, in some implementations, the pump system 100 may have a flow frequency that is significantly lower than other pump systems. For example, the disclosed pump system 100 may have a flow frequency in a range of between, for example, approximately 20 cycles per minute and approximately 100 cycles per minute. In some other implementations, the flow frequency may be up to approximately 60 cycles per minute, for example. In other implementations, the flow frequency may be up to 120 cycles per minute or up to 200 cycles per minute, for example. At such low flow frequencies, damage to the primary fluid 103 is reduced. It will be appreciated that the aforementioned dimensions for the inner liner 126 and the aforementioned flow frequency are non-limiting examples and thus, other dimensions of the inner liner 126 and other flow frequencies are still within the scope of this disclosure.

Additionally, this type of pump may provide for the lowest shear rate of all pump technology currently applied in biopharmaceutical applications, based on the gentle pump action, and valve designs. As a further example, this pump system 100 can achieve application as a single use pump with a very low (e.g., the lowest) disposable mass of pumping elements to be changed between production campaigns. In this way, for example, environmental concerns regarding waste can be mitigated. This pump system 100 may also allow for the lowest valve activations per unit of flow, and the lowest valve contribution to shear rate. In general, the pump system 100 allows for very low potential damage to the pumped primary fluid 103, and this pump system 100 has a flow path that is significantly straighter than alternative technologies, which reduces effects of turbulent flow. These low shear rates and the pump operation that will be described herein also result in the pumping of primary fluid 103 with the lowest possible pulsation characteristic.

The secondary pump 104 is operably coupled to the primary pump 102 via various tubing, quick release fittings, and valves. For example, first tubing 109 may fluidly couple the first piston chamber 108 of the secondary pump to the secondary fluid chamber 132 of the first pump unit 122 of the primary pump 102. In some implementations, the first tubing 109 may be detachably connected to either side of a quick release fitting A such that the quick release fitting A provides a detachable connection between the first piston chamber 108 of the secondary pump 104 and the first pump unit 122 of the primary pump 102. The first tubing 109 may be coupled to the secondary fluid chamber 132 of the first pump unit 122 via a secondary fluid port 145 of the first pump unit 122. Similarly, in some implementations, second tubing 111 may fluidly couple the second piston chamber 110 of the secondary pump 104 may to the second pump unit 124 of the primary pump 102. In some implementations, the second tubing 111 may be detachably connected to either side of a quick release fitting B such that the quick release fitting B provides a detachable connection between the second piston chamber 110 of the secondary pump 104 and the second pump unit 124 of the primary pump 102. The second tubing 111 may be coupled to the secondary fluid chamber 132 of the second pump unit 124 via a secondary fluid port 145 of the second pump unit 124.

Further, each of the first and second pump units 122, 124 may be removably attached to the primary fluid inlet 133 at, for example, an inlet quick release valve 134 (e.g., a first valve) and may be removably attached to the primary fluid outlet 135 at an outlet quick release valve 136 (e.g., a second valve). Thus, the inlet quick release valve 134 is proximate the primary fluid inlet 133, and the outlet quick release valve 136 is proximate the primary fluid outlet 135. The inlet and outlet quick release valves 134, 136 may be one-way valves such that the primary fluid 103 can flow in a same, single direction from the primary fluid inlet 133 and to the primary fluid outlet 135. In some implementations, the inlet and outlet quick release valves 134, 136 are passive valves. In some other implementations, the inlet and outlet quick release valves 134, 136 are electronically controlled, actuated valves. In some implementations, as shown in FIG. 2, for example, each of the first pump unit 122 and the second pump unit 124 have an inlet quick release valve 134 and an outlet quick release valve 136. In other implementations, the first pump unit 122 and the second pump unit 124 share a single inlet quick release valve 134 and a single outlet quick release valve 136. In some other implementations, connection features other than quick release valves 134, 136 may be used to couple the first and second pump units 122, 124 to the primary fluid inlet 133 and the primary fluid outlet 135. In some other implementations, the quick release valves 134, 136 are simply one-way valves (e.g., allow fluid flow in single direction) that are integrated within the input and output of the inner cells 126. For example, in some implementations, the one-way valves 134, 136 are part of a same mold as the input and output of the inner cells 126 such the quick release valves 134, 136 and inner cell 126 of each pump unit 122, 124 is monolithic.

In some implementations, each of the first and second pump units 122, 124 comprise a port connection 140. The port connection 140 of the first pump unit 122 is coupled to first capillary tubing 141 that is submerged in the secondary fluid sump 106 of the secondary pump 104. In some implementations, a quick release fitting F is coupled to the first capillary tubing 141 to provide a detachable connection between the primary pump 102 and the secondary pump 104. Similarly, the port connection 140 of the second pump unit 124 is coupled to second capillary tubing 143 that is submerged in the secondary fluid sump 106 of the secondary pump 104. In some implementations, a quick release fitting G is coupled to the second capillary tubing 143 to provide a detachable connection between the primary pump 102 and the secondary pump 104.

As will be discussed further herein, in some implementations, the primary pump 102 may be removed from the secondary pump 104 via the quick release fittings A, B, F, and G, and may be removed from the primary fluid inlet 133 and primary fluid outlet 135 via the inlet quick release valve 134 and the outlet quick release valve 136. The removability of the primary pump 102 from the overall pump system 100 improves accessibility of features of the primary pump 102 for sanitation and/or disposal, which is especially useful in biological or biopharma applications. As will be discussed further herein, in some other implementations, features of the primary pump 102 may be accessed without disconnecting the quick release fittings A, B, F, G and without disconnecting the primary pump 102 from the primary fluid inlet and outlet 133, 135. In some such other implementations, features of the primary pump 102 may still be accessed for sanitation and/or disposal; and because the primary pump 102 is not disconnected from the secondary pump 104, leakage of and contamination by the primary and/or secondary fluid 103, 120 is mitigated.

Additionally, various valves are also provided in the secondary pump 104 to assist with draining and priming processes used when a primary pump 102 is detached and/or a new primary pump 102 is attached to the secondary pump 104. In some implementations, draining the secondary fluid 120 from the secondary fluid chambers 132 of the primary pump 102 after a pumping operation reduces waste and also prevents contamination of the secondary fluid 120 with other pump parts. Further, such draining and priming processes reduce air in the secondary fluid 120 which provides for more gentle and more accurate pumping of the primary fluid 103 through the inner liners 126.

In some implementations, a first piston oil valve C1 (e.g., a fourth valve) is fluidly coupled to the first piston chamber 108 and is arranged below the first piston chamber 108. The first piston oil valve C1 may be coupled to the first tubing 109. The first piston oil valve C1 is a two-way valve, meaning the first piston oil valve C1 provides bi-directional fluid communication when opened between the secondary fluid 120 housed in the secondary fluid sump 106 and the secondary fluid 120 housed in the first piston chamber 108. For example, secondary fluid 120 may enter the first piston chamber 108 through the first piston oil valve C1 to restore the volume of secondary fluid 120 within the first piston chamber 108. During a purging operation, secondary fluid 120 may exit the first piston chamber 108 through the first piston oil valve C1 to remove the secondary fluid 120 from the piston chamber 108. Similarly, in some implementations, a second piston oil valve C2 is fluidly coupled to the second piston chamber 110 and is arranged below the second piston chamber 110. The second piston oil valve C2 may be coupled to the second tubing 111. The second piston oil valve C2 is a two-way valve, meaning the second piston oil valve C2 provides bi-directional fluid communication when opened between the secondary fluid 120 housed in the secondary fluid sump 106 and the secondary fluid 120 housed in the second piston chamber 110 to either remove or restore the volume of secondary fluid 120 within the second piston chamber 110. In some implementations, the amount of secondary fluid 120 in the first and/or second piston chambers 108, 110 is decreased inadvertently due to leakage, is decreased due to a purging operation, or is decreased during maintenance of the pump system 100. The first and second piston oil valves C1, C2 may be passive valves, pressure-relief valves, electronically operated valves, or some other suitable valve structure.

In some implementations, a first vent valve D1 (e.g., a third valve) is coupled to the second piston chamber 110 and is coupled to the port connection 140 of the first pump unit 122 via the first capillary tubing 141. In some implementations, a second vent valve D2 is coupled to the first piston chamber 108 and is coupled to the port connection 140 of the second pump unit 122 via the second capillary tubing 143. In some implementations, the first and second vent valves D1, D2 are one-way valves that are configured to allow excess secondary fluid 120 and any entrapped air therein of out the first and second pump units 122, 124 and/or out of the first and second piston chambers 108, 110. As "one-way" valves, each of the first and second vent valves D1, D2 only allow fluid flow in a single direction; in this instance, the first and second vent valves D1, D2 only allow fluid flow into the secondary fluid sump 106. In some other implementations, the first and second vent valves D1, D2 may not be directly coupled to the first and second piston chambers 108, 110. Because the first and second vent valves D1, D2 are submerged below the secondary fluid 120 in the secondary fluid sump 106, any air that exits via the first and second vent valves D1, D2 rises to the air above the secondary fluid 120 in the secondary fluid sump 106 to remove air from the secondary fluid 120 in the overall pump system 100. Further, because the first and second vent valves D1, D2 are submerged in the secondary fluid 120 and are each one-way valves, air is not drawn back into the first and second pump units 122, 124 via the first and second vent valves D1, D2. The first and second vent valves D1, D2 may be passive valves, pressure-relief valves, electronically operated valves, or some other suitable valve structure.

In some implementations, the first capillary tubing 141 couples the first pump unit 122 of the primary pump 102 to both the second piston chamber 110 of the secondary pump 104 and the first vent valve D1. In some other implementations, the first capillary tubing 141 couples the first pump unit 122 of the primary pump 102 to both the first piston chamber 108 of the secondary pump 104 and the second vent valve D2. In some implementations, the second capillary tubing 143 couples the second pump unit 124 of the primary pump 102 to both the first piston chamber 108 of the secondary pump 104 and the second vent valve D2. In some other implementations, the second capillary tubing 143 couples the second pump unit 124 of the primary pump 102 to both the second piston chamber 110 of the secondary pump 104 and the first vent valve D1.

In some implementations, each of the first and second pump units 122, 124 of the primary pump 102 may further comprise an intermediate liner 144 arranged between the inner liner 126 and the outer liner 128. The intermediate liner 144 may comprise a flexible material, and the secondary fluid chamber 132 may be defined by outer surfaces of the intermediate liner 144 and inner surfaces of the outer liner 128. In some implementations, an intermediate chamber 146 may be arranged between the primary fluid chamber 130 and the secondary fluid chamber 132. The intermediate chamber 146 may be defined by outer surfaces of the inner liner 126 and inner surfaces of the intermediate liner 144. The intermediate chamber 146 may comprise air or fluid. In some other implementations, an intermediate chamber 146 may not exist between the intermediate liner 144, and instead, the intermediate liner 144 may contact the inner liner 126 such that the intermediate liner 144 and the inner liner 126 move as one during pumping.

The intermediate liner 144 may provide additional structure and protection to the inner liner 126. Thus, if the inner liner 126 were to leak, the intermediate liner 144 would still separate the primary fluid 103 from the secondary fluid 120. Similarly, if the intermediate liner 144 were to leak, the inner liner 126 would still separate the primary fluid 103 from the secondary fluid 120. It will be appreciated that the presence of the intermediate liner 144 depends on the design of the pump system 100 and/or the intended use of the pump system 100. Thus, the intermediate chamber 146 may not be present in all implementations, and is therefore illustrated as a dotted line throughout the figures of this application. In some implementations, because the intermediate chamber 146 contains a small amount of air or liquid and thus, the intermediate chamber 146 is very small and is illustrated with white shading throughout the figures of this application.

In some implementations, the first pump unit 122 is coupled to an air valve E1 (e.g., a fifth valve), and the second pump unit 124 is coupled to an air valve E2. Each of the air valves E1, E2 are one-way valves, meaning these air valves E1, E2 only allow air to flow in a single direction when opened. The air valves E1, E2 may be passive valves, pressure-relief valves, electronically operated valves, or some other suitable valve structure. As will be discussed further herein, the chamber that each air valve E1, E2 is coupled to and whether the air valves E1, E2 are inlet or outlet valves depending on the design of the first and second pump units 122, 124. For example, in implementations that include the intermediate liner 144 and the intermediate chamber 146, the air valves E1, E2 may be air outlet valves and be fluidly coupled to the intermediate chambers 146 of the first and second pump units 122, 124. Dotted line 150 illustrates such implementations where each intermediate chamber 146 is fluidly coupled to its respective air valve E1, E2, and where the air valves E1, E2 function as air outlet valves. In implementations that do not include the intermediate liner 144 and/or do not include the intermediate chamber 146, the air valves E1, E2 may be air inlet valves and be fluidly coupled to the secondary fluid chambers 132 of the first and second pump units 122, 124. Striped line 148 illustrates such implementations where each secondary fluid chamber 132 is fluidly coupled to its respective air valve E1, E2 and the air valves E1, E2 function as air inlet valves are illustrated via striped lines 148. As will be discussed further herein, in yet other implementations, the air valves E1, E2 may be completely omitted. In still yet some other implementations, additional air valves (e.g., E3, E4 not pictured) may be present such that the intermediate chambers 146 are each coupled to an air outlet valve (e.g., E1, E2 via dotted line 150), while the secondary fluid chambers 132 are each coupled to an air inlet valve (e.g., E3, E4, which are not illustrated but would be coupled to the secondary fluid chambers 132 via striped line 148). Thus, depending on the design of the first and second pump units 122, 124, each air valves E1, E2 may be coupled to only one of the intermediate chamber 146 or the secondary fluid chamber 132.

It will be appreciated that FIGS. 1 and 2 are exemplary and that more than two piston chambers 108, 110 of the secondary pump 104 and more than two pump units 122, 124 of the primary pump 102 may be used. In some implementations, the number of piston chambers used in the secondary pump 104 is equal to the number of components used in the primary pump 102 such that pumping of each piston chamber controls pumping in each component.

During pumping, valves C1, C2, D1, and D2, are closed while the actuators 114, 118 continuously change the pistons 112, 116 between two positions. The state of the air valves E1, E2 during pumping depends on the function of the air valves E1, E2. For example, when the air valves E1, E2 are air inlet valves and coupled to the secondary fluid chambers 132, the air valves E1, E2 are closed during pumping. When the air valves E1, E2 are air outlet valves and coupled to the intermediate chambers 146, the air valves E1, E2 are non-return valves that can only direct air out of the intermediate chambers 146. The pistons 112, 116 move in opposite directions during pumping such that each inner liner 126 moves between opposite positions (e.g., expanded versus compressed). Therefore, primary fluid 103 is continuously transported between the primary fluid inlet 133 and the primary fluid outlet 135.

Figure 3:
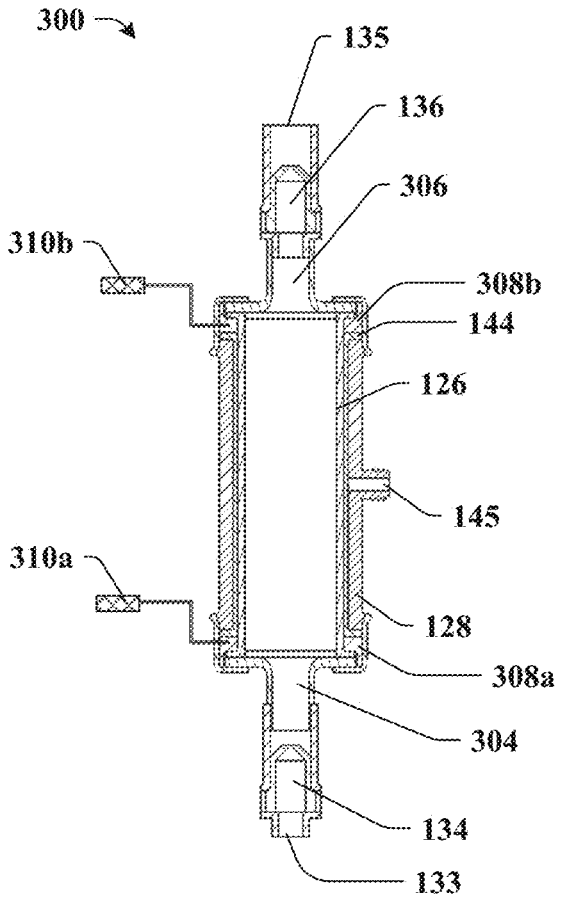
FIG. 3 illustrates a cross-sectional view of some implementations of a cartridge design for a pump unit comprising an inner, expandable liner as described herein.

Turning additionally to FIG. 3, a cross-sectional view of some implementations of the first and second pump units 122, 124 of the primary pump is illustrated. In some such implementations, the first and second pump units 122, 124 may have a cartridge design 300 to allow convenient removal and replacement of the inner liners 126 after a pumping operation.

In some implementations, the first and second pump units 122, 124 may be selectively accessed for replacement or maintenance. In biological applications, for example, it may be more reliable and sanitary to completely replace the inner liners 126 than to attempt to sanitize previously used inner liners 126. In some implementations, the cartridge design 300 of the first and second pump units 122 still comprises the inner liner 126, the outer liner 128, the inlet quick release valve 134 proximate the primary fluid inlet 133, the outlet quick release valve 136 proximate the primary fluid outlet 135, and the secondary fluid port 145 extending through the outer liner 128. In some implementations, the secondary fluid port 145 has a barbed tubing structure configured to receive and securely fit to the first or second tubing 109, 111. In some implementations, the inner liner 126 may have tubular shape extending and elongated between the inlet and outlet quick release valves 134, 136. In some implementations, the inner liner 126 may be sealed to the inlet quick release valve 134 via a first sealing structure 304. The first sealing structure 304 may fit within the inlet quick release valve 134 and seal over outer edges of the inner liner 126. In some implementations, the inner liner 126 may be sealed to the outlet quick release valve 136 via a second sealing structure 306. The second sealing structure 306 may fit within the outlet quick release valve 136 and seal over outer edges of the inner liner 126. The first and second sealing structures 304, 306 may be structured as flat gaskets, for example. The first and second sealing structures 304, 306 maintain the pressure and/or vacuum state between the inner liner 126 and the intermediate liner 144.

In some implementations, the cartridge design 300 may further comprise the intermediate liner 144 arranged between the inner liner 126 and the outer liner 128. In some such implementations, first and second intermediate sealing structures 308*a*, 308*b* may be arranged near an input end and output end of the inner liner 126 to seal a space between the intermediate liner 144 and the inner liner 126. In some implementations, the intermediate liner 144 directly contacts the inner liner 126 such that an intermediate chamber (e.g., 146 of FIG. 2) does not exist between the intermediate liner 144 and the inner liner 126. In some implementations, a first vacuum output 310*a* may be coupled to the first intermediate sealing structure 308*a* to remove any air from the space between the intermediate liner 144 and the inner liner 126. In some implementations, a second vacuum output 310*b* may be coupled to the second intermediate sealing structure 308*b* to remove any air from the space between the intermediate liner 144 and the inner liner 126. In such implementations, the intermediate liner 144 and the inner liner 126 may completely contact one another and move as one membrane. In some other implementations, the intermediate chamber (e.g., 146 of FIG. 2) does exist between the intermediate liner 144 and the inner liner 126 and is filled with air or a liquid. It will be appreciated that the first vacuum output 310*a*, the second vacuum output 310*b*, and/or the intermediate liner 144 may be omitted depending on the design and intended application of the cartridge design 300.

While the inner liner 126 and the intermediate liner 144 are flexible to pump the primary fluid 103 through the primary fluid chamber 130, the outer liner 128 of the cartridge design 300 is rigid. The rigid outer liner 128 retains the pressure and volume of the secondary fluid 120 and also protects the inner liner 126 and the intermediate liner 144. In some implementations, the outer liner 128 comprises a polymer, a metal, carbon fiber composite, other composite, some other suitable rigid or semi-rigid material. In some implementations, the inner liner 126 and the intermediate liner 144 comprise a same, flexible material, such as silicon, a polymer film, or some other suitable material. In some other implementations, the inner liner 126 and the intermediate liner comprise different materials and/or have different thicknesses. Because the first and second pump units 122, 124 may be completely removed and replaced from the overall pump system 100 when in the form of the cartridge design 300, lightweight, inexpensive, and recyclable materials are most suitable to reduce costs and waste of the disposable component.

Removing and replacing a first or second pump unit 122, 124 using the cartridge design 300 may reduce damage to the inner liner 126, prevent leakage to amongst seals between the liners (e.g., 126, 128, 144), and prevent contamination to the primary fluid chamber 130. As will be discussed later herein, prior to removing the cartridge design 300 from the pump system 100, a purging process may be conducted to completely or substantially remove the secondary fluid 120 from the secondary fluid chamber 132 of the first and second pump units 122, 124. Removing the secondary fluid 120 conserves the secondary fluid 120 in the pump system 100 and also prevents contamination of other parts of the pump system 100 with the secondary fluid 120. Upon replacing the first and/or second pump units 122, 124 with the cartridge design 300, a priming operation may be conducted to remove air from the the secondary fluid chamber 132 while also filling up the secondary fluid chamber 132 with secondary fluid 120.

Though not pictured for simplicity, it will be appreciated that capillary tubing and other quick release valves described in FIG. 2 may be coupled the cartridge design 300. In some implementations, such capillary tubing would be disconnected from the pump system 100 at quick release valves A, B, F, and G to remove the cartridge design 300 from the pump system 100. Then, a new cartridge design 300 could be reconnected to the pump system 100 at the inlet and outlet quick release valves 134, 136 and at the quick release valves A, B, F, and G.

FIGS. 4A, 4B, 4C, 4D, 4E, and 4F illustrate various views of some implementations of a clamshell design 400 of the first and second pump units 122, 124 for convenient removal and replacement of the inner liners 126 of the primary pump 102. In some such implementations, the first and second pump units 122, 124 do not need to be disconnected and reconnected to the pump system 100 at the inlet and outlet quick release valves 134, 136 and at the quick release valves A, B, F, and G in order to access the inner liner 126. In some such implementations, leakage of the secondary fluid 120 at the quick release valves 134, 136, A, B, F, and G may be avoided.

Figure 4A:
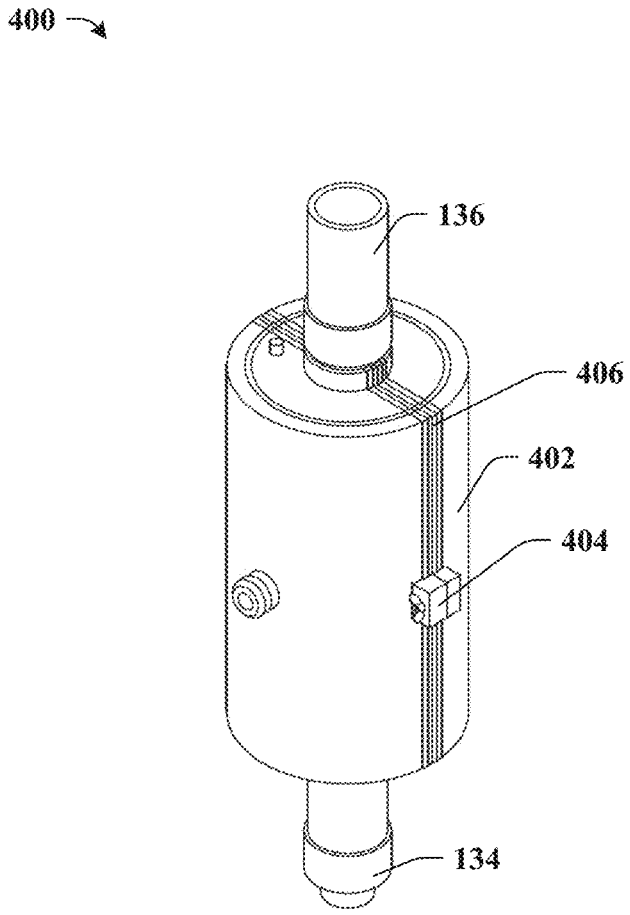
FIGS. 4A, 4B, 4C, and 4D illustrate various views of some implementations of a clamshell design for a pump unit comprising an inner, expandable liner as described herein.
Figure 4B:
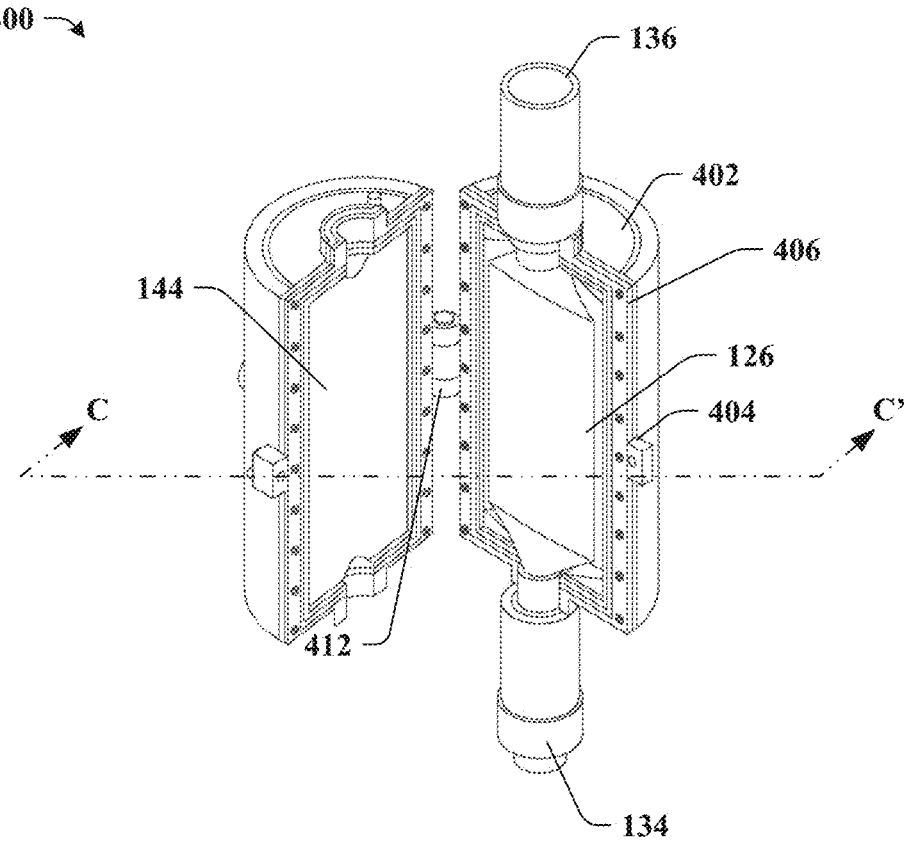
Figure 4C:
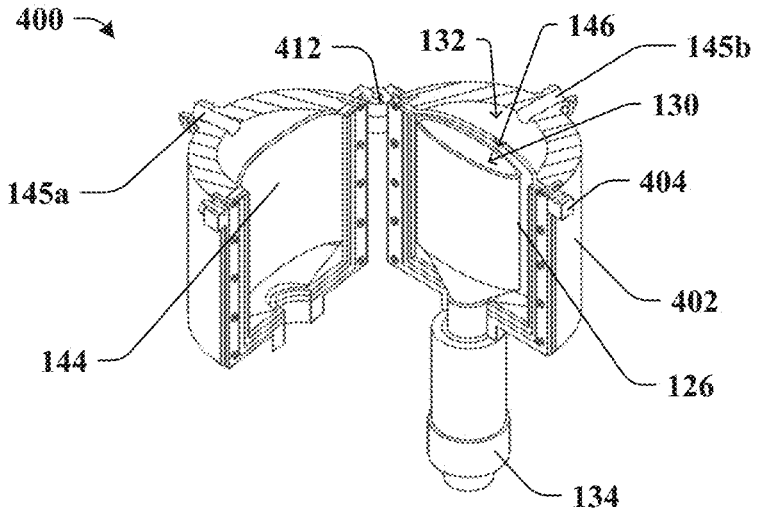
Figure 4D:
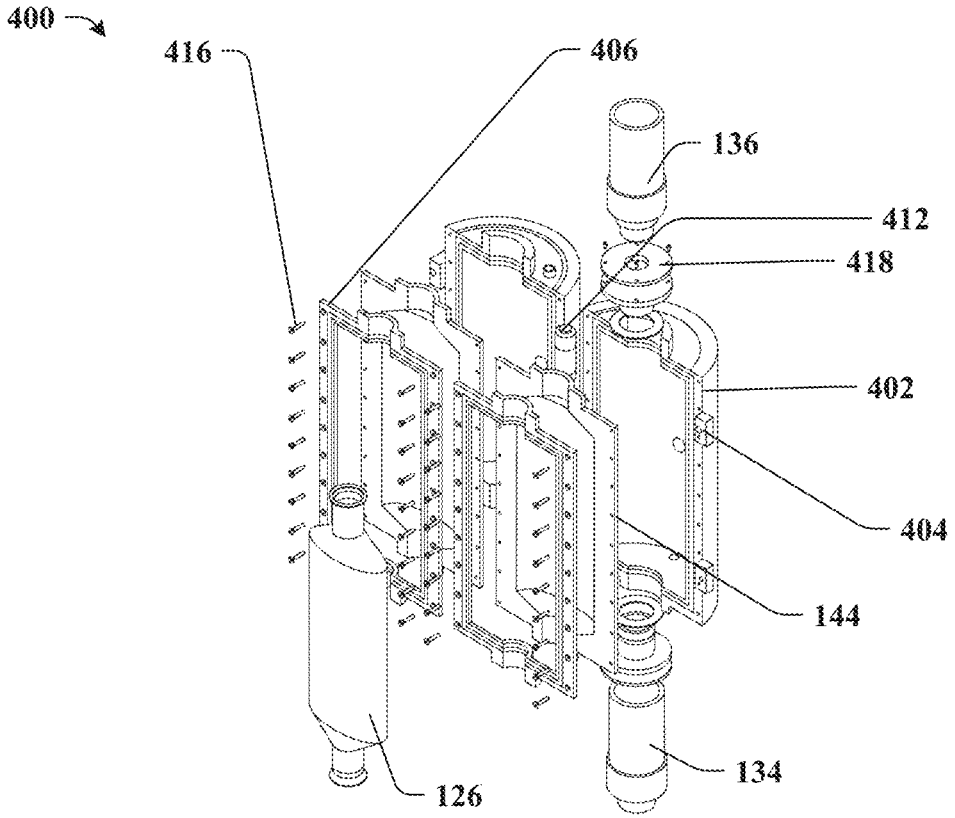
Figure 4E:
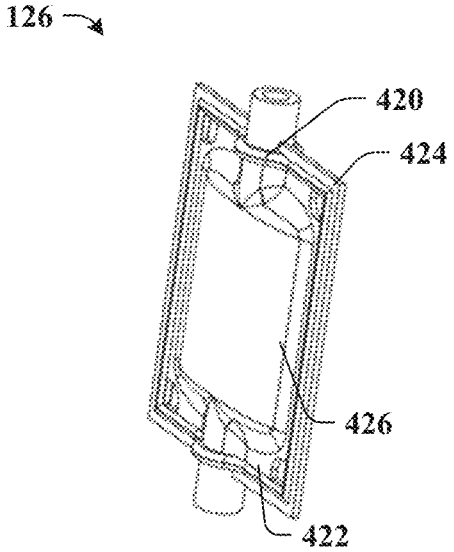
FIGS. 4E and 4F illustrate perspective views of some implementations of an inner expandable liner as described herein that may be used in the clamshell design of FIGS. 4A, 4B, 4C, and 4D.
Figure 4F:
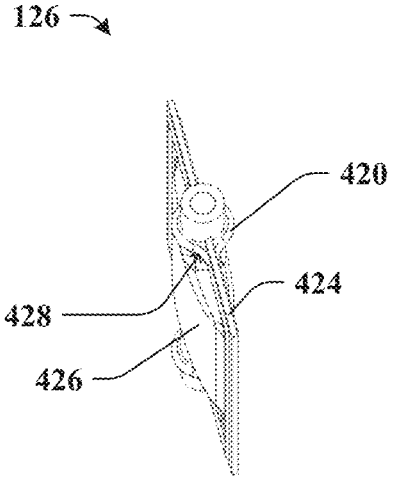

FIG. 4A illustrates a perspective view of the clamshell design 400 when closed. FIG. 4B illustrates a perspective view of the clamshell design 400 when opened. FIG. 4C illustrates a cross-sectional view of the clamshell design 400 that may correspond to cross-section line CC' of FIG. 4B. FIG. 4D illustrates an exploded view of the clamshell design 400. FIGS. 4E and 4F illustrate perspective views of some implementations of the inner liner 126 of the clamshell design 400.

In some implementations, the first and second pump units 122, 124 each have a clamshell design 400 as shown in FIGS. 4A-4F. In some implementations, the clamshell design 400 comprises a clamshell body 402 that can be opened at a fixture 404 such that the clamshell body 402 opens along a hinge 412 to access the inner liner 126, as best shown in FIG. 4B. The clamshell design 400 further comprises a two-piece intermediate liner 144. At least one sealing support 406 may be arranged at the seam of the clamshell body 402 to provide a seal along the clamshell body 402 to preserve pressure and fluid volume within the clamshell body 402 upon closing and pumping of the clamshell design 400. In some implementations, the clamshell design 400 comprises two sealing supports 406, wherein each sealing support 406 surrounds outer edges and seals the two-piece intermediate liner 126 to each side of the clamshell body 402.

In some implementations, as shown in FIGS. 4E and 4F, the inner liner 126 comprises a chamber portion 426 which defines the primary fluid chamber 130. Further, the inner liner 126 may comprise webbing 422 that is coupled to the chamber portion 426 but does not define the primary fluid chamber 130 of the inner cell 126. Thus, the webbing 422 can be pinched and secured between the sealing supports 406. Thus, the webbing 422 may assist in sealing and defining the intermediate chamber 146 of the clamshell design 400. In some implementations, the inner liner 126 further comprises a branch sealing feature 420 arranged at the necking near the input and output of the inner liner 126. The branch sealing feature 420 radially protrudes from the inner liner 126 at the necking of the inner liner 126 to effectively seal the chambers within the clamshell design 400 upon closing and performing a pump operation with the clamshell design 400. In some implementations, the achieve sufficient sealing of the intermediate chamber 146 of the clamshell design 400, the branch sealing feature 420 includes an inflection point 428 where the concavity of the branch sealing feature 420 changes to effectively surround and seal the necking of the inner liner 126. The features of the inner liner 126 of FIGS. 4E and 4F may be a single piece for effective sealing and easy install of the inner liner 126 in the clamshell design 400.

The two-piece intermediate liner 144 may also be arranged at the seam of the clamshell body 402 on either side of the sealing support 406 to further preserve pressure and fluid volume within the clamshell body 402. In some implementations, when the clamshell design 400 is closed, the inner liner 126 defines the primary fluid chamber 130, and inner surfaces of the clamshell body 402 with outer surfaces of the two-piece intermediate liner 144 define the secondary fluid chamber 132. The two-piece intermediate liner 144 is fastened to the clamshell body 402 when opened and when closed to contain the secondary fluid 120 within the clamshell body 402 even when the clamshell body 402 is opened. Thus, the clamshell body 402 may be opened to selectably separate each side of the two-piece intermediate liner 144 in order to remove and replace the inner liner 126. While each side of the two-piece intermediate liner 144 is separated when the clamshell body 402 is opened, the two-piece intermediate liner 144 and the clamshell body 402 still house the secondary fluid 120 in the secondary fluid chamber 132.

To control the pressure and volume of the secondary fluid 120 within the secondary fluid chamber 132 during pumping, a first secondary fluid port 145*a* may be fluidly coupled to a first side of the secondary fluid chamber 132, and a second secondary fluid port 145*b* may be coupled to a second side of the secondary fluid chamber 132. In some implementations, the first and second secondary fluid ports 145*a*, 145*b* may be coupled to a same piston chamber. Thus, the flow of the secondary fluid 120 can be simultaneously controlled in both secondary fluid chambers 132, thereby providing smooth pumping of the primary fluid 103 within the primary fluid chamber 130. In some other implementations, only one of the first or second secondary fluid ports 145*a*, 145*b* is coupled to a piston chamber, while the other of the first or second secondary fluid ports 145*a*, 145*b* is not fluidly coupled to a piston chamber. In some such other implementations, only one of the secondary fluid chambers 132 may be controlled by a piston chamber such that pumping of the primary fluid 103 is only controlled by one of the secondary fluid chambers 132 of the clamshell design 400. Because of the separated secondary fluid chambers 132 in the clamshell design 400, waste of parts is reduced and contamination by the secondary fluid 120 is mitigated in the clamshell design 400 when replacing the inner liner 126. Further, priming and purging processes may be eliminated or reduced because the secondary fluid 120 does not need to be drained in order to access the inner liner 126. In some implementations, the two-piece intermediate liner 414 surrounds the inner liner 126. In some implementations, an intermediate chamber 146 is arranged between outer surfaces of the inner liner 126 and the two-piece intermediate liner 414. In some implementations, a vacuum process may be performed upon closing the clamshell body 402 and/or during a pumping process to eliminate air in the intermediate chamber 146 such that the two-piece intermediate liner 414 contacts the inner liner 126. For example, in some such implementations, the intermediate chamber 146 may be coupled to an air valve (e.g., E1 or E2 of FIG. 2) that is a non-return valve and allows air to escape from the intermediate chamber 146 as pumping begins. In some other implementations, the intermediate chamber 146 may be coupled to a vacuum to remove air from the intermediate chamber 146. In yet other implementations, another fluid or air may fill the intermediate chamber 146 and remain at the same volume during pumping. In still yet some other implementations, upon closing of the clamshell design 400, no action may be taken to remove or fill the intermediate chamber 146 with air or a fluid. Nevertheless, the two-piece intermediate liner 414 may contain the secondary fluid 120 within the clamshell body 402 while also providing another barrier of protection for the primary fluid 103.

It will be appreciated that while the inner liner 126 is intended to be frequently replaced in the clamshell design 400, other features of the clamshell design 400 may also be accessed and maintained as needed. Thus, the clamshell design 400 may still comprise the inlet and outlet quick release valves 134, 136 for easy removal of the clamshell design 400 as needed. Further, in some implementations, gaskets 418 are arranged between the inlet and outlet quick release valves 134, 136 and the clamshell body 402 for proper sealing of the clamshell design 400 to the primary pump 102. In some implementations, the capillary tubing and other quick release valves described in FIG. 2 would remain coupled to the clamshell body 402 upon opening the clamshell body 402 to replace the inner liner 126.

Figure 5:
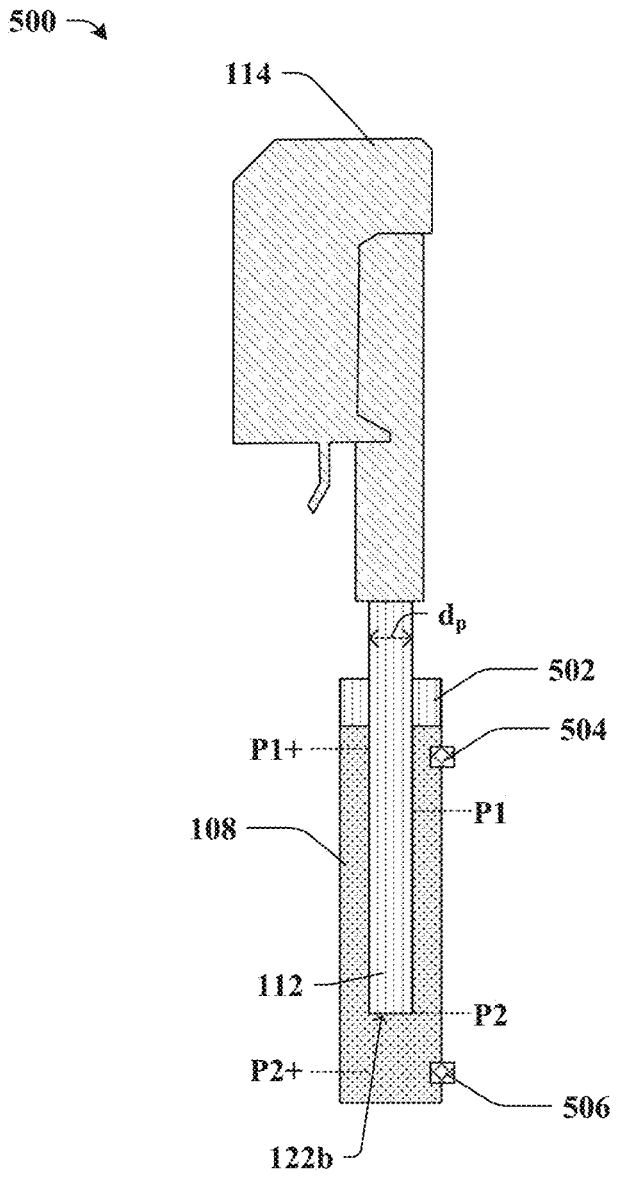
FIG. 5 illustrates a cross-sectional view of some implementations of a piston system as described herein.

FIG. 5 illustrates a schematic of a piston system 500 used herein. For simplicity, the piston system 500 will be described with respect to the first piston 112, the first actuator 114, and the first piston chamber 108 of the pump system 100. It will be appreciated that the second piston 116, the second actuator 114, and the second piston chamber 110 of the pump system 100 would embody the same or similar features as described in FIG. 5.

In some implementations, the piston system 500 further comprises a rod seal 502, an air purge port 504, and a secondary fluid transmission port 506. The rod seal 502 is configured to seal the first piston chamber 108 and maintain the volume and pressure of fluid in the first piston chamber 108 even as the piston 112 moves up and down within the first piston chamber 108. The air purge port 504 of the first piston chamber 108 may be coupled to the second capillary tubing 143 and the valve D2. The secondary fluid transmission port 506 of the first piston chamber 108 may be coupled to the first tubing 109 and the valve C1. During pumping, the first actuator 114 is configured to move the first piston 112 between a first position P1 to increase a volume of the first piston chamber 108 and a second position P2 to decrease the volume of the first piston chamber 108. To provide a consistent fluid flow, the first actuator 114 may be a linear actuator. As will be discussed later herein, in some implementations, the first piston 112 is occasionally moved further above the first position P1 to an over-extended first position P1+ to further increase the volume of the first piston chamber 108. Similarly, as will be discussed later herein, in some implementations, the first piston 112 is occasionally moved further below the second position P2 to an over-extended second position P2+ to further reduce the volume of the first piston chamber 108. In some implementations, the first piston 112 has a stroke length which is a distance between the first position P1 and the second position P2. Further, the first piston 112 has a piston diameter $d_p$ measured in a lateral direction.

Figure 6:
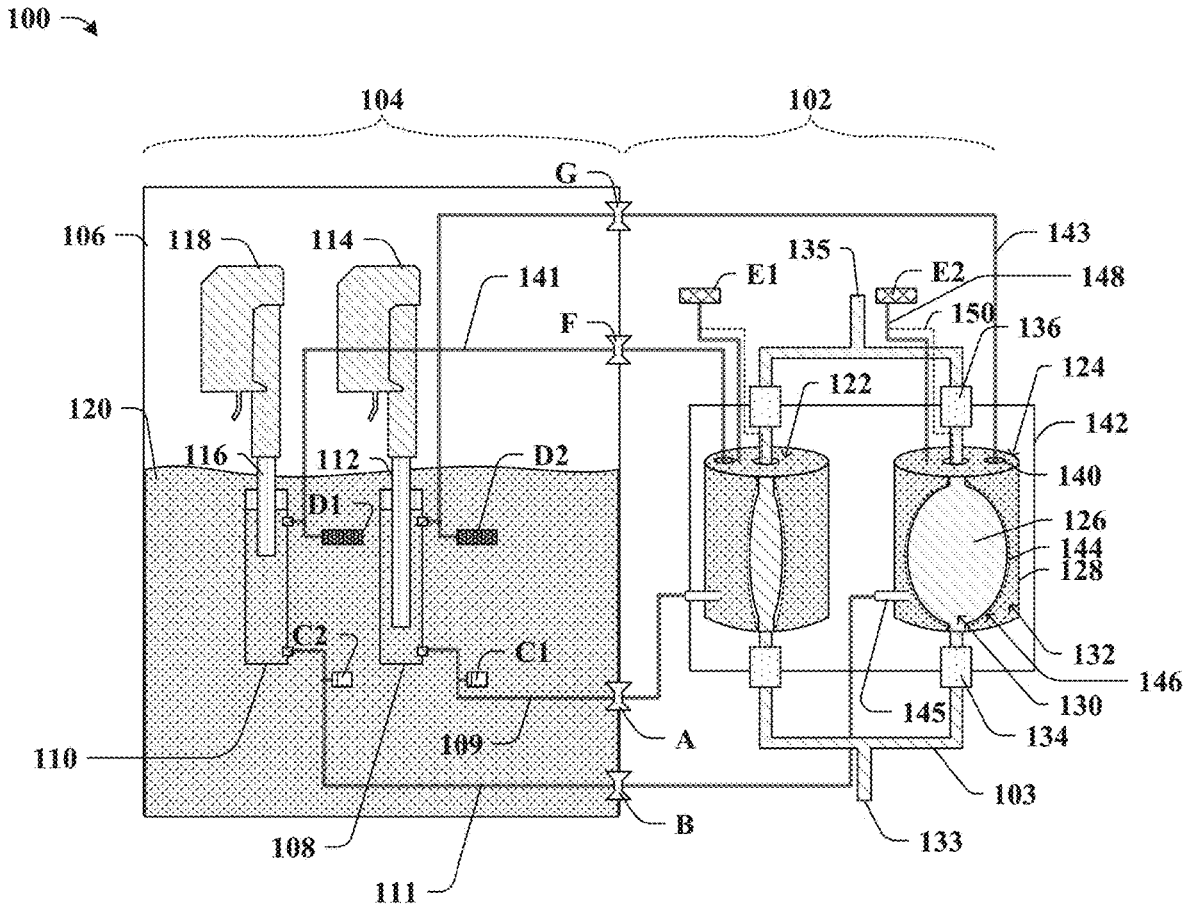
FIGS. 6 and 7 illustrate cross-sectional views of some implementations of the pump system described herein during a pumping operation.
Figure 7:
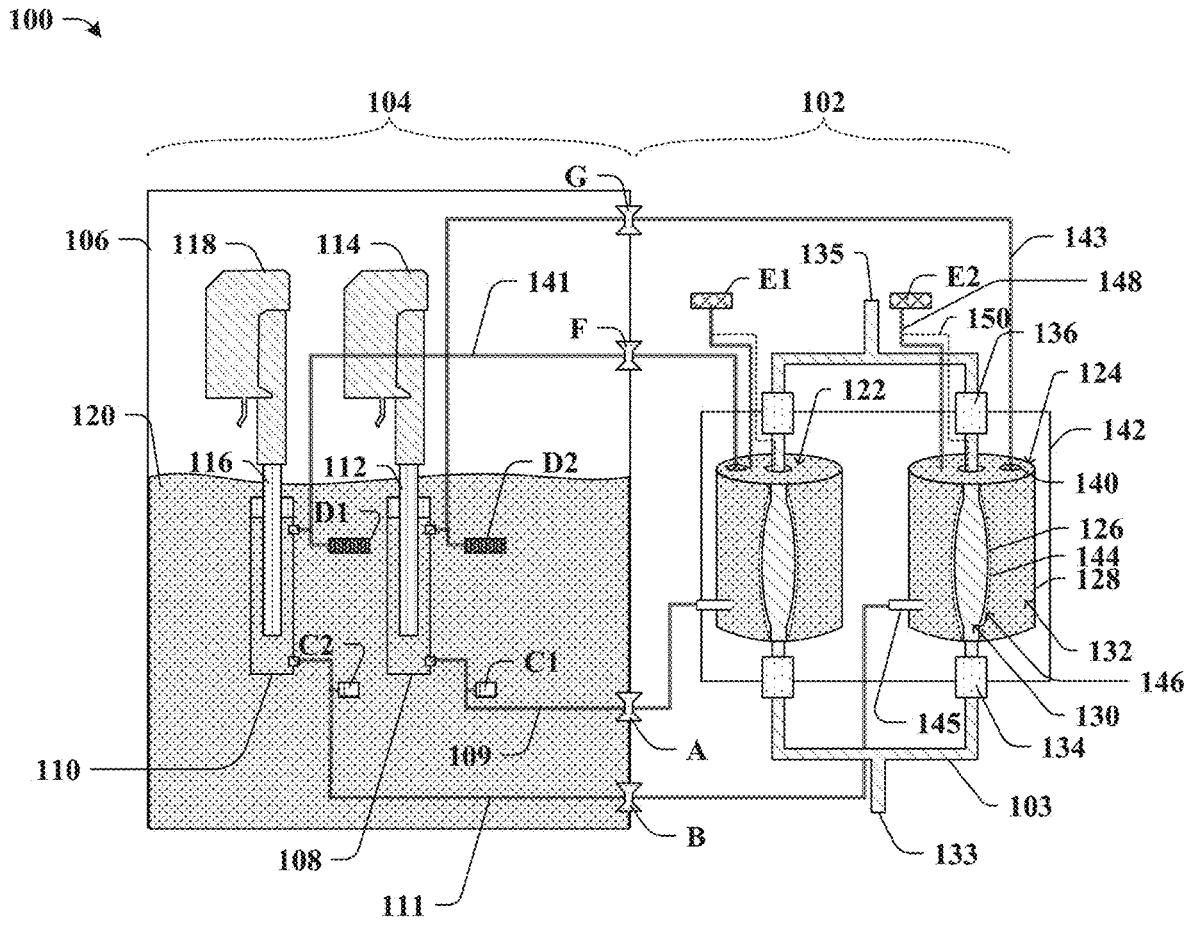

Turning back to FIG. 2 and additionally to FIGS. 6 and 7, a pumping operation of the pump system 100 will be described. Each FIGS. 5, 6, and 7 illustrates the pump system 100 at a moment in time during a pumping operation.

FIG. 2 illustrates the pump system 100 at a moment in time during a pumping operation. In FIG. 2, the first piston 112 is in position 1 (P1), while the second piston 116 is in position 2 (P2) such that less secondary fluid 120 is in the second piston chamber 110 than the first piston chamber 108. When the first piston 112 is in P1, the second piston 116 is in P2. Further, when the first piston 112 is in P1, the inner liner 126 of the first pump unit 122 is in an expanded, intake position. When the second piston 116 is in P2, the inner liner 126 of the second pump unit 124 is in a compressed, output position. Turning additionally to FIG. 6, as pumping continues from the moment in time shown in FIG. 2 to the moment in time in FIG. 6, the first actuator 114 moves the piston 112 from P1 and into P2, while the second actuator 118 moves the second piston 116 from P2 and into P1. As the first piston 112 moves from P1 into P2 between FIGS. 2 and 6, the first piston 112 pushes secondary fluid 120 into the secondary fluid chamber 132 of the first pump unit 122 and compresses the inner liner 126 of the first pump unit 122 thereby expelling primary fluid 103 out of the primary fluid chamber 130 of the first pump unit 122 and towards the primary fluid outlet 135. As the second piston 116 moves from P2 into P1 between FIGS. 2 and 6, the second piston 116 removes secondary fluid 120 from the secondary fluid chamber 132 of the second pump unit 124 and allows the inner liner 126 of the second pump unit 124 to expand thereby allowing primary fluid 103 to enter the primary fluid chamber 130 of the inner liner 126 in the second pump unit 124. Thus, when the first piston 112 is in P2 as shown in FIG. 6, the inner liner 126 of the first pump unit 122 is in compressed, output position. When the second piston 116 is in P1 as shown in FIG. 2, the inner liner 126 of the second pump unit 124 is in an expanded, intake position.

The inlet and outlet quick release valves 134, 136 are check valves or timed solenoid valves which open and close depending on the state of the inner liner 126 and thus, the position of each piston 112, 116. During pumping, as one of the inner liners 126 expands as secondary fluid 120 is pumped out of the corresponding secondary fluid chamber 132, the corresponding inlet quick release valve 134 opens as the outlet quick release valve 136 closes to allow primary fluid 103 into the expanding inner liner 126. Similarly, as one of the inner liners 126 is compressed as secondary fluid 120 is pumped into the corresponding secondary fluid chamber 132, the corresponding inlet quick release valve 134 closes as the outlet quick release valve 136 opens to allow primary fluid 103 to exit the contracting inner liner 126. The inlet and outlet quick release valves 134, 136 open and close at low velocity periods of the primary fluid flow 103 to reduce shear on the primary fluid 103.

Additionally, during pumping, if the air valves E1, E2 are air inlet valves that are coupled to the secondary fluid chambers 132, the air valves E1, E2 are closed to retain the volume of the secondary fluid 120 within the secondary fluid chambers 132. In other implementations, if the air valves E1, E2 are air outlet valves that are coupled to the intermediate chambers 146, the air valves E1, E2 are open to allow air to escape from the intermediate chambers 146. In some such implementations, the air valves E1, E2 may be non-return valves such that air can only escape from the intermediate chambers 146 and cannot enter the intermediate chambers 146. In yet other implementations, air valves E1, E2 may be omitted from the pump system 100.

Turning additionally to FIG. 7, at the beginning and end of the pumping operation of the pumping system 100, both the first and second pistons 112, 116 may return to P2 such that the inner liners 126 are both in the compressed, output position. Thus, the inner liners 126 are not in an expanded state; this may reduce stress on the inner liners 126 while the pumping operation is paused, thereby improving the lifetime of the inner liners 126. Additionally, when the inner liners 126 are in the compressed state, less primary fluid 103 is trapped and stationary within the inner liners 126 while pumping is paused. It will be appreciated that in other implementations, the pistons 112, 116 may be at P1 at the beginning and/or end of the pumping operation.

In some implementations, at the beginning of the pumping operation, the primary fluid chambers 130 of the first and second pump units 122, 124 are empty. In other implementations, at the beginning of the pumping operation, the primary fluid chambers 130 of the first and second pump units 122, 124 filled with primary fluid 103. In some implementations, at the end of the pumping operation, the primary fluid chambers of the first and second pump units 122, 124 are filled with primary fluid. As will be discussed further herein, a purging operation may be performed to empty the first and second pump units 122, 124 of secondary fluid 120 and of primary fluid 103 for access to the primary pump 102.

Figure 8:
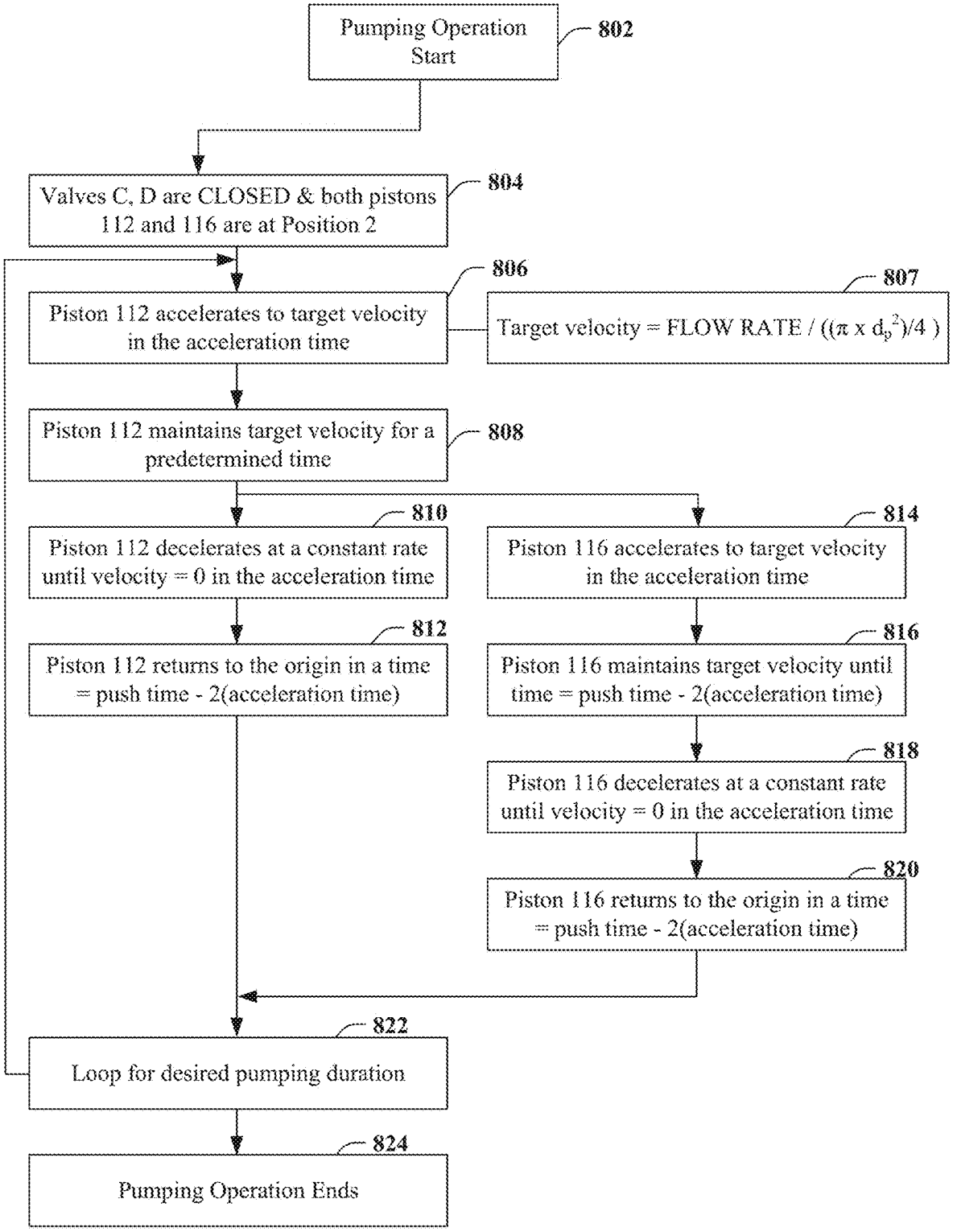
FIG. 8 illustrates a flow diagram of some implementations of performing a pumping operation as described herein.

FIG. 8 illustrates a flow chart of some implementations of a pumping operation method that may correspond to what was described above with respect to FIGS. 2, 6, and 7. FIG. 8 additionally describes the state of each valve during the pumping operation. In some such implementations, valves C1, C2, D1, and D2 may be electronic valves, such as solenoid valves, controlled by a microcontroller. In some other implementations, the valves C1, C2, D1, and D2 may be pressure relief valves. It will be appreciated that in this flow chart as well as others discussed herein, "valve C" refers to valves C1 and C2; "valve D" refers to valves D1 and D2; and "valve E" refers to valves E1 and E2.

At 802, the pumping operation is started. In some implementations, the pump system 100 is coupled to a computer processer that automatically starts the pumping operation according to a predetermined schedule. At least the first and second actuators 114, 118 of the pump system 100 may be controlled by a computer processor. In other implementations, the pump system 100 may be controlled by a computer processor but initiated manually by a user, for example.

At 804, the pumping operation begins by closing valves C and D and bringing the pistons 112, 116 to P2. As discussed above, the air valves E1, E2 may be opened or closed during the pumping operation, depending on which chamber the air valves E1, E2 are coupled to.

At 806, one of the pistons, for example, the first piston 112 is accelerated to a target velocity over an acceleration time such that the first piston 112 begins to move from P1 and toward P2. The flow rate of the pump system 100 is determined by an average velocity of the pistons 112, 116. The pump system 100 is a positive displacement volumetric device and thus, the flow rate of the pump system 100, which is also the flow rate of the secondary fluid 120 and the flow rate of the primary fluid 103, is supposedly independent of differential pressure.

Assuming that the flow rate is in fact independent of differential pressure, then the average velocity of the pistons 112, 116 is the same as a target velocity. As indicated at 807, the (flow rate) is then equal to (target velocity)*($\pi d_p^2/4$), where $d_p$ is the diameter of the first and second pistons 112, 116.

At 808, the first piston 112 maintains the target velocity for a predetermined time. In some implementations this predetermined time is equal to (push time)—(2*acceleration time), which will be defined in FIG. 9.

At 810, the first piston 112 decelerates at a constant rate until the velocity equals zero. The time it takes for the velocity to equal zero is equal to the acceleration time, as can be better understood in view of FIG. 9.

At 812, the first piston 112 returns to its origin in the same predetermined time from 508, which is equal to (push time)–(2*acceleration time).

At 814, the second piston 116 accelerates to a target velocity over the acceleration time. The acceleration of the second piston 116 at 814 happens as the first piston decelerates at 510.

At 816, the second piston 116 maintains the target velocity for a predetermined time. In some implementations this predetermined time is equal to (push time)–(2*acceleration time), which will be defined in FIG. 9. The velocity of the second piston 116 is maintained at 816 at the same time as 812, where the first piston 112 returns to its origin.

At 818, the second piston decelerates at a constant rate until the velocity equals zero. The time it takes for the velocity to equal zero is equal to the acceleration time, as can be better understood in view of FIG. 9.

At 820, the second piston returns to its origin in the same predetermined time from 808, which is equal to (push time)–(2*acceleration time).

At 822, the steps from 806-820 are repeated for a desired pumping duration until the pumping operation concludes at 824. When the steps are continuously repeated, step 806 will occur at the same time as step 818, and step 808 will occur at the same time as step 820.

Figure 9:
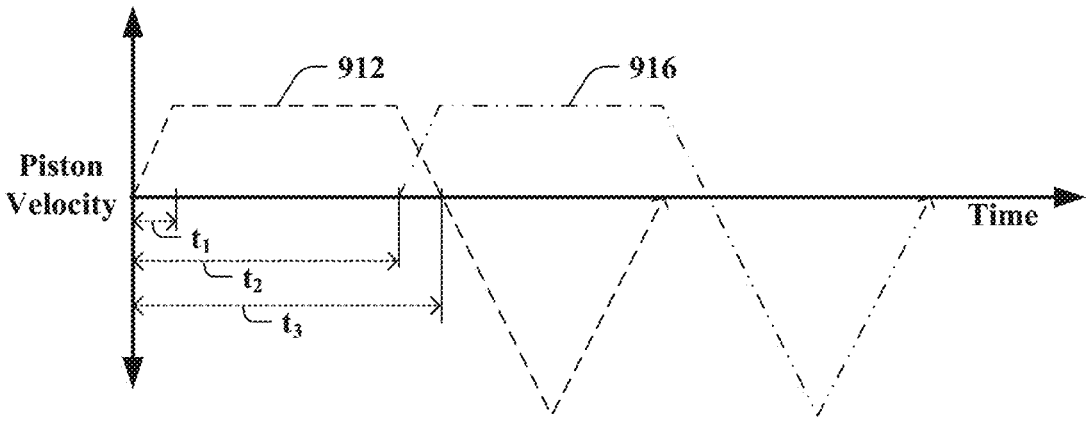
FIGS. 9 and 10 illustrate plots of some implementations of various parameters of the pump system versus time when the pump system is undergoing a pumping operation as described herein.

Referring additionally to FIG. 9, a piston velocity versus time graph is illustrated that may correspond to some implementations of the method described in FIG. 8. It will be appreciated that because piston velocity depends upon flow rate, so the y-axis of the plot in FIG. 9 may also be labeled as flow rate. In FIG. 9, line 912 corresponds to the velocity over time for the first piston 112 when undergoing the pumping operation described in FIG. 8. Similarly, line 916 corresponds to the velocity over time for the second piston 116 when undergoing the pumping operation described in FIG. 8.

As shown by line 912, the first piston 112 initially accelerates over a first time $t_1$ before plateauing at a constant velocity. This first time $t_1$ is the "acceleration time" discussed in FIG. 8. The first and second pistons 112, 116 both accelerate and decelerate between zero velocity and the constant velocity over the same first time $t_1$. A second time $t_2$ is labeled in FIG. 9, which corresponds to the time that the first piston 112 initially accelerates and plateaus at a constant velocity before decelerating, which is also the time that the second piston 116 takes before beginning its first pump movement of the pumping operation. The second time $t_2$ may be referred to as the "start time" for the second piston 116. A third time $t_3$ is also labeled in FIG. 9, which corresponds to the time period at which the first piston 112 has a positive velocity, and thus, is moving from P1 and into P2. The third time $t_3$ is the "push time" discussed in FIG. 8. The second piston 116 will have the same push time $t_3$ as the first piston 112, as supported by line 912 and line 916 in FIG. 9. The pistons 112 or 116 are moving from P2 and back to P1 when the velocity is negative in FIG. 9. It will be appreciated that the lines 912 and 916 may each be repeated and overlap as shown in FIG. 9 throughout the pumping operation described in FIG. 8.

Figure 10:
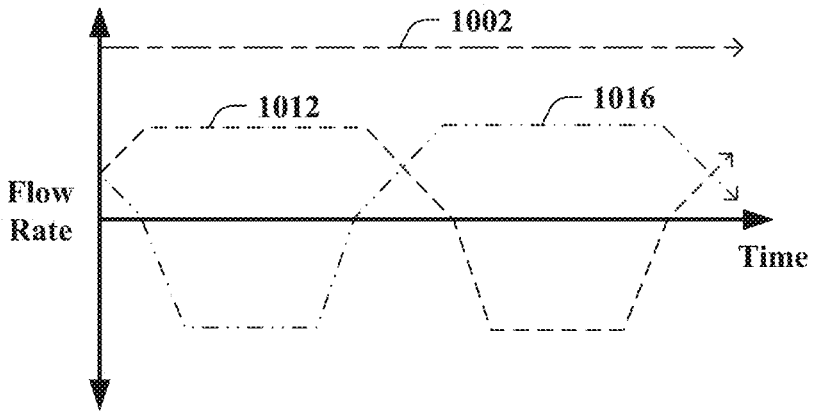

Turning additionally to FIG. 10, a plot of flow rate versus time is illustrated that may correspond to the flow rate of various components of the pump system 100 during the pump operation. It will be appreciated that because flow rate depends upon piston velocity, so the y-axis of the plot in FIG. 10 may also be labeled as piston velocity. Line 1012 may correspond to the flow rate of the secondary fluid 120 in the first piston chamber 108 during the pump operation, while line 1016 may correspond to the flow rate of the secondary fluid 120 in the second piston chamber 110 during the pump operation. Because of the valving and actuator controls in the described pump system 100, the overall flow rate of the pump system 100 is represented at line 1002. Thus, the primary fluid 103 is pumped between the primary fluid inlet 133 and the primary fluid outlet 135 at a constant flow rate. Removing pump pulsations supports stable, low flow rate in pressure sensitive applications like filtration and increases gentle handling of the primary fluid 103, thereby reducing damage to the entrained particles in the primary fluid 103.

For example, in some implementations, the first and second actuators 114, 118 may be part of a programmable actuator system such that the first and second actuators 114, 118 can be pre-programmed and continuously controlled by a computer processor. In some implementations, it may be beneficial to connect the first and second pistons 112, 116 using a linear actuator. As an example, when a linear actuator is used, the stroke displacement can be finely controlled and synchronized with the alternate pistons 112, 116 such that the pump displacement rate remains at a substantially net constant value for the entirety of the pumping cycle, as illustrated by line 1002 in FIG. 10. For example, using this method can mitigate flow and pressure pulsations, which also reduces vibrations within the primary fluid 103 and overall pump system 100. A reduction in vibrations of the pump system 100 reduces damage to the delicate particles entrained in the primary fluid 103. Often, downstream equipment or fluid components may be sensitive to pulsations or varied flow. These types of pulsation can potentially damage biological structures, disrupt, or damage filter efficiency, and upset chromatography column packing that are all common biopharmaceutical process considerations. Thus, in some implementations, linear actuators are selected for the first and second actuators 114, 118 to appropriately choreograph the pumping actions, such as by pump timing of the pistons 112, 116 to flatten the pulses as shown by line 1002 in FIG. 10.

In other implementations, the first and second actuators 114, 118 may be connected to a crank or cam shaft that is configured to provide a predetermined timing for actuation of the pistons resulting in a sinusoidal pumping motion. The control of the first and second pistons 112, 116 may be less, and thus, some pulsation may occur during a pumping operation for the overall flow rate of the primary fluid 103. Some pulsations in the overall flow rate of the pump system 100 may be tolerable depending on the primary fluid 103 used.

Thus, in some implementations, the pump system 100 may be controlled by predetermined motions of the valves and pistons 112, 116 and require minimal user intervention. In some such implementations, the pump system 100 may be controlled by an input voltage or current that proportionally corresponds to the piston velocity. For example, in some implementations, an input voltage between, for example, approximately 0 volts and approximately 10 volts or a current between, for example, approximately 0 milliamps to approximately 20 milliamps may be applied to the pump system 100. In some such implementations, a 0 volt input or a 0 milliamp input may correspond to operating the pump system 100 at a piston velocity equal to 0% of the maximum piston velocity; a 5 volt input or a 10 milliamp input may correspond to operating the pump system 100 at a piston velocity equal to 50% of the maximum piston velocity; and a 10 volt input or a 20 milliamp input may correspond to operating the pump system 100 at a piston velocity equal to 100% of the maximum piston velocity. It will be appreciated that the aforementioned voltage and current values are merely examples, and thus, other voltage and current values may be implemented depending on the complexity and size of the pump system 100, for example.

In some implementations, the pump system 100 may be controlled through user interaction with the pump system 100. For example, in some implementations, a user may input operation parameters into a computer processor coupled to the pump system 100. In some implementations, the user may input operation information at an LCD screen or keypad coupled to the computer processor and pump system 100. User-input may be based on a target flow rate for the pump system 100, a target pressure of the pump system 100, or a desired time. A proportional-integral-derivative (PID) controller may adjust the operation of the pump system 100 according to the user input.

Referring additionally to FIGS. 11-15, a purging operation of the pump system 100 will be discussed. In some implementations, after a pumping operation is performed, at least the inner liners 126 of the primary pump 102 may be removed and replaced. In some implementations, the inner liners 126 of the primary pump 102 may be proactively replaced due to wear-and-tear or may be replaced to pump a new, different primary fluid 103. The purging operation removes the secondary fluid 120 from the primary pump 102 such that secondary fluid 120 is not wasted and also does not contaminate other parts of the pump system 100 when the first and second pump units 122, 124 are accessed for replacement or routine maintenance. In biological applications, for example, it may be more reliable and sanitary to completely replace the inner liners 126 than to attempt to sanitize previously used inner liners 126. As discussed previously the frequency of a purging process may depend on the design of the first and second pump units 122, 124. For example, when using a cartridge design 300, a purging process may be performed each time before an inner liner 126 is replaced to preserve the secondary fluid 120 in the pump system 100. When using a clamshell design 400, a purging process may be performed as needed for maintenance or recalibration, for example. In other implementations, when using a clamshell design 400, a purging process may never be necessary.

Figure 13:
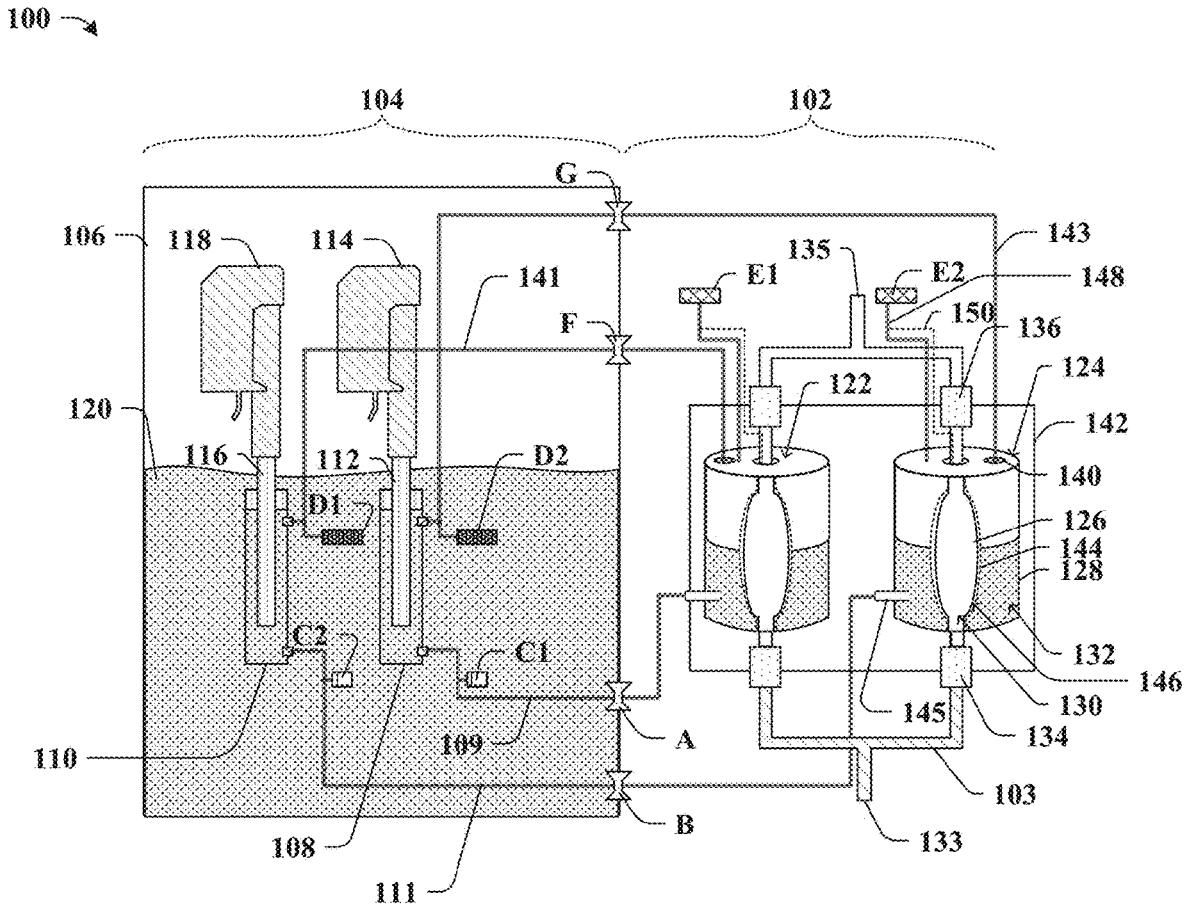
Figure 14:
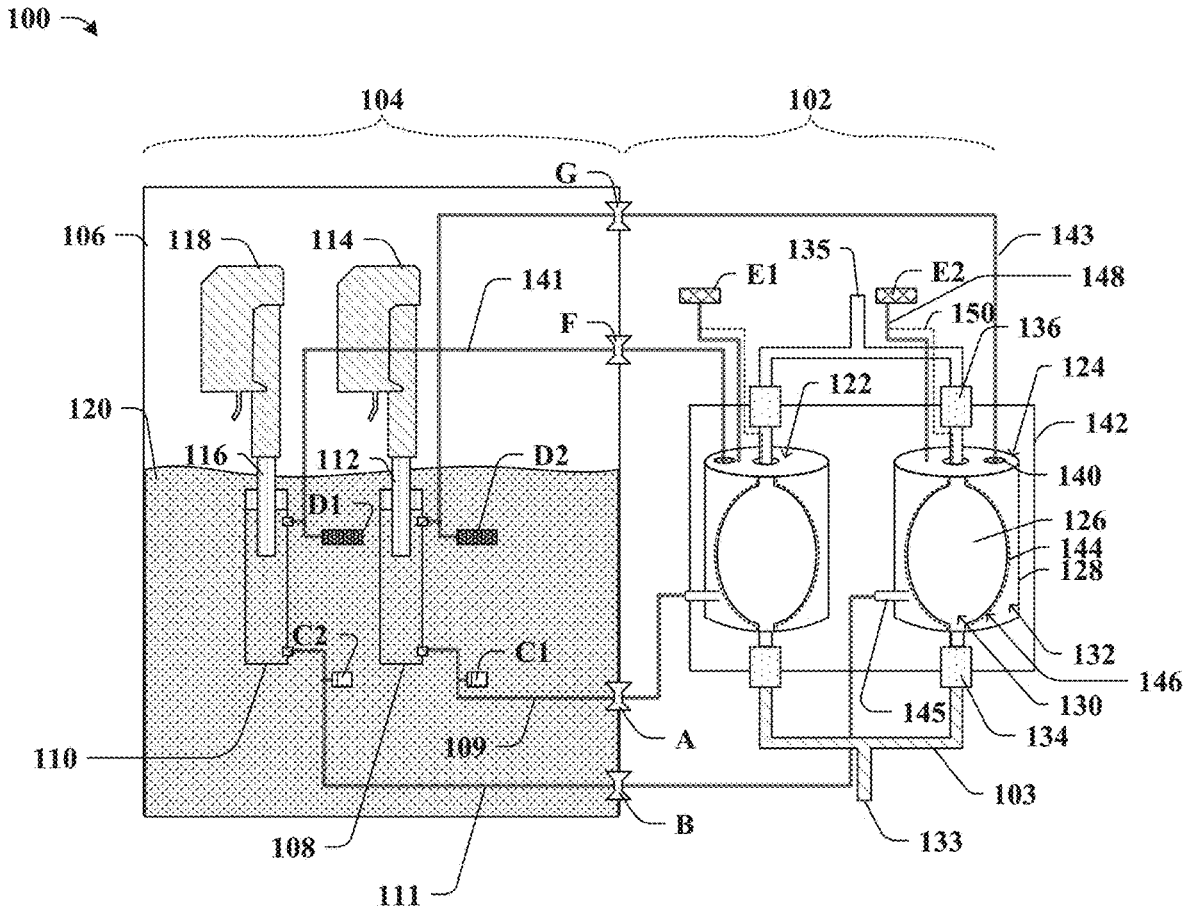
Figure 15:
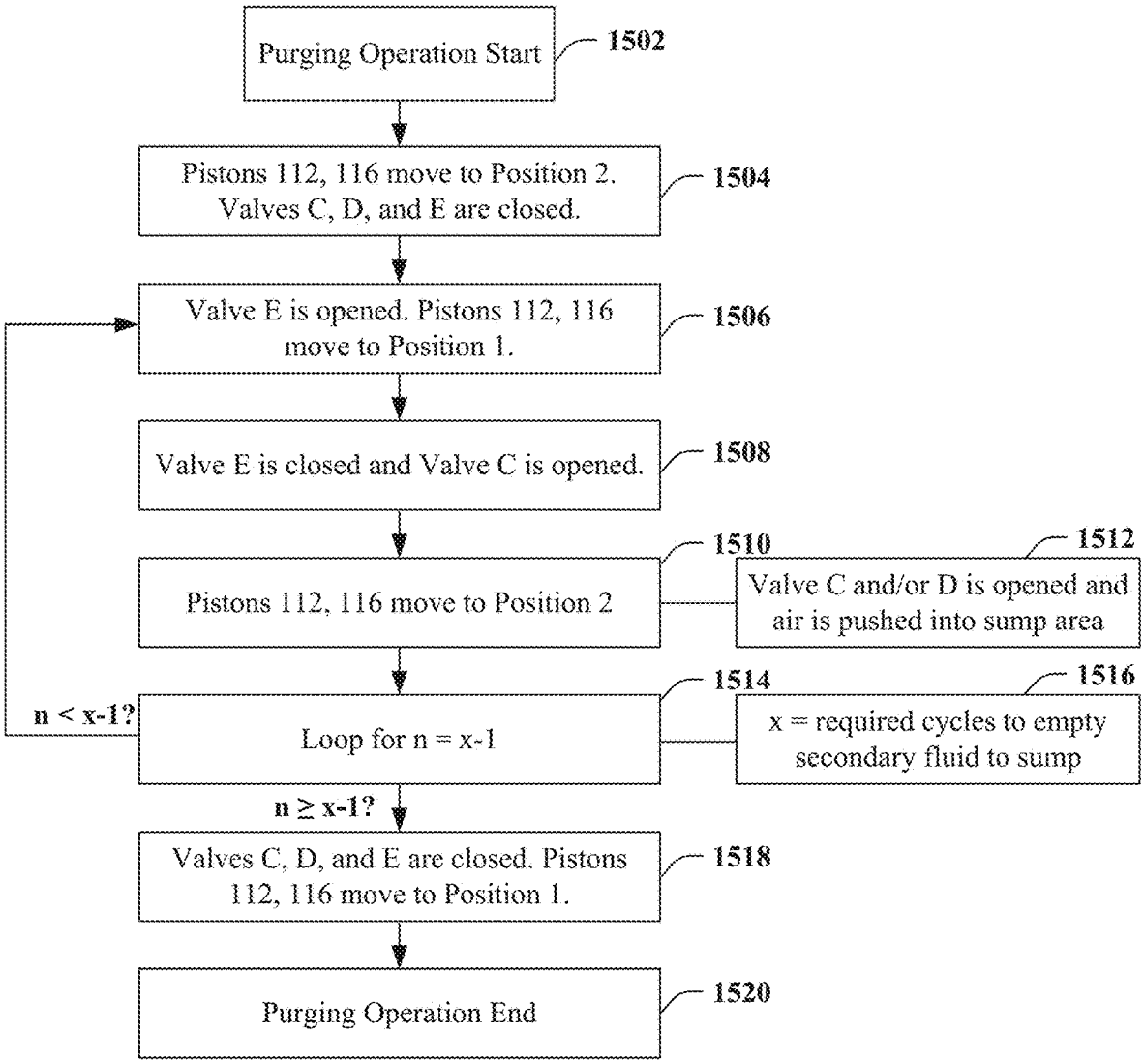
FIG. 15 illustrates a flow diagram of some implementations of performing a purging operation as described herein.

FIGS. 11, 12, 13, and 14 each schematically represent a moment in time of the pump system 100 during the purging operation, and FIG. 15 illustrates a flow chart of some implementations of the purging operation method that may correspond to FIGS. 11-14.

In pump systems 100 that utilize a purging process, the air valves E1, E2 are air inlet valves that are coupled to the secondary fluid chambers 132 of the primary pump 102. Thus, air may enter the secondary fluid chambers 132 during purging to force secondary fluid 120 out of the secondary fluid chambers 132. Therefore, in the following purging operation steps, air valves E1, E2 are one-way air inlet valves that when opened, allow air to only enter the secondary fluid chambers 132. In some implementations, if the pump system 100 comprises intermediate liners 144 and intermediate chambers 146, the intermediate chambers 146 may be coupled to some other air outlet valve or vacuum valve. In other implementations, even if the intermediate liners 144 are present, another air valve or vacuum valve may be omitted from the pump system 100.

Figure 11:
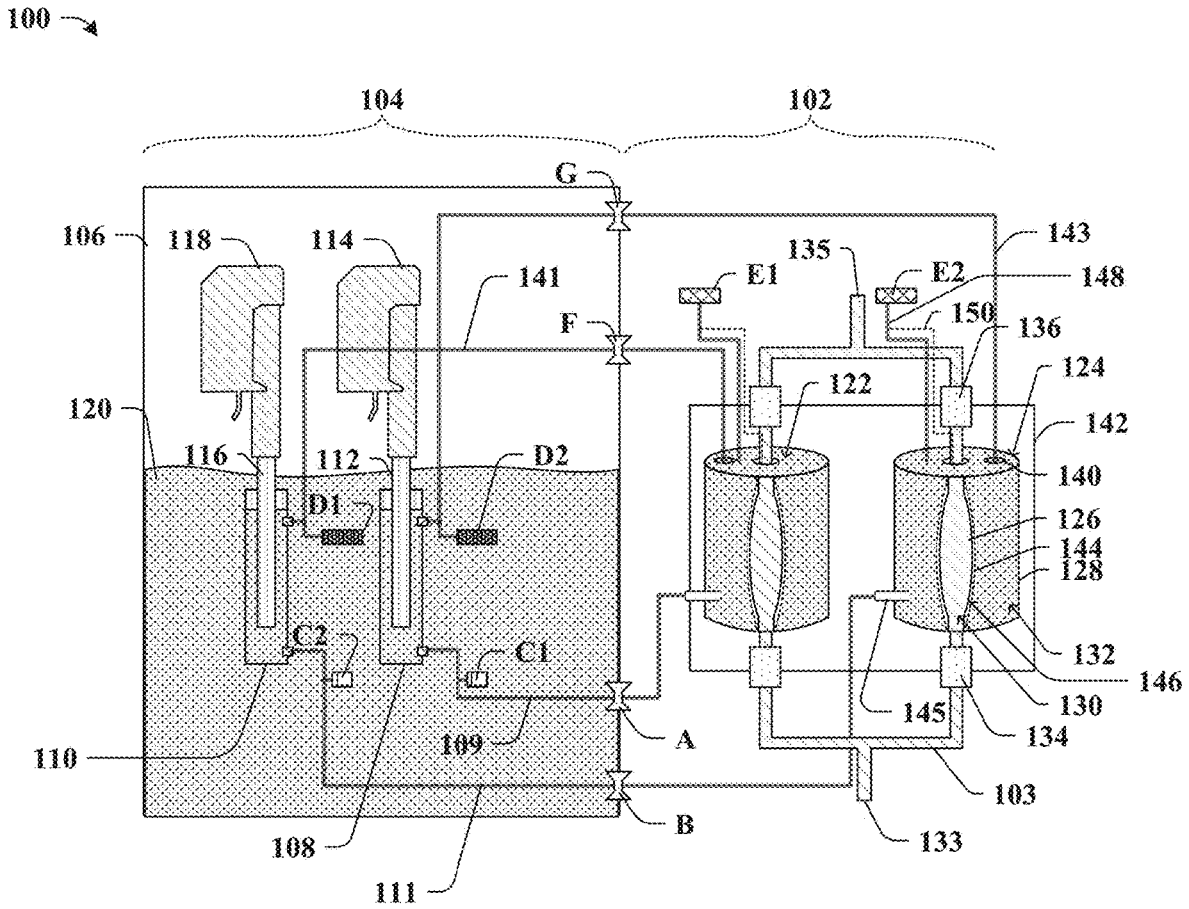
FIGS. 11, 12, 13, and 14 illustrate cross-sectional views of some implementations pump system at various moments in time during a purging operation as described herein.

As shown in FIG. 11, after a pumping operation is paused, the purging process begins by moving the first and second pistons 112, 116 to P2 while valves C1, C2, D1, D2, E1, and E2 remain closed from the pumping operation. The secondary fluid 120 compresses the inner liners 126 of the primary pump 102. In some implementations, the first and second pistons 112, 116 may already be at P2 and the valves C1, C2, D1, D2, E1, and E2 may already be closed from the pumping operation; thus, the positions of the pistons 112, 116 and inner liners 126 of FIG. 11, which illustrates the beginning of the purging operation may be the same as those in FIG. 7, which illustrates the end of the pumping operation.

Figure 12:
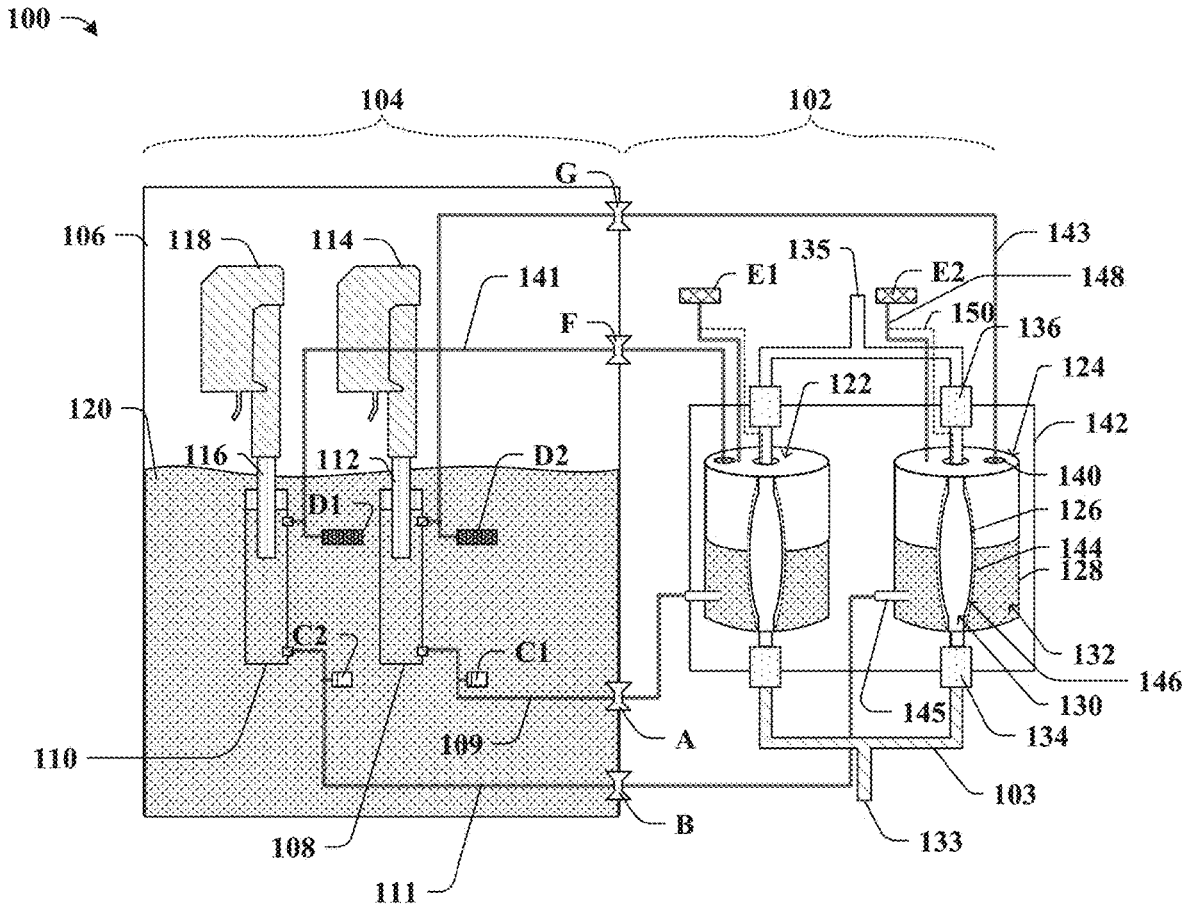

As shown in FIG. 12, the first and second air inlet valves E1, E2 are opened and the first and second pistons 112, 116 are moved into P1. As the first and second pistons 112, 116 move to P1, the secondary fluid 120 is drawn into the first and second piston chambers 108, 110 from the secondary fluid chambers 132 of the primary pump 102, and air is drawn into the secondary fluid chambers 132 of the primary pump 102 via the first and second air inlet valves E1, E2.

Further, the inner liners 126 may remain compressed because of the air input into the secondary fluid chambers 132. Because the inlet and outlet quick release valves 134, 136 of the primary pump 102 are one-way, as the secondary fluid 120 and air input compresses the inner liners 126 of the primary pump 102 as the first and second pistons 112, 116 are pushed to P2 in FIG. 11 and then brought back to P1 in FIG. 12, the inlet quick release valves 134 are closed while the outlet quick release valves 136 are open. In turn, the primary fluid 103 is at least partially drawn out of the primary fluid chambers 130 of the primary pump 102. The primary fluid chambers 130 are illustrated with white shading in FIG. 12 to indicate that the primary fluid chambers 130 are empty or partially empty of the primary fluid 103. Pumping primary fluid 103 out of the primary fluid chambers 130 of the primary pump 102 reduces waste of the primary fluid 103 when the inner liners 126 are later removed for replacement, cleaning, or the like.

As shown in FIG. 13, once the first and second pistons 112, 116 are in P1, the first and second air valves E1, E2 are closed, the first and second piston oil valves C1, C2 are opened, and the first and second pistons 112, 116 are moved into P2. Additionally, the first and second vent valves D1, D2 are opened such that any secondary fluid 120 and trapped air therein can vent out of the secondary fluid chambers 132 of the primary pump 102. In other implementations, the first and second vent valves D1, D2 may remain closed during the entire purging operation. At FIG. 13, secondary fluid 120 can also escape the first and second piston chambers 108, 110 via the open piston oil valves C1, C2. If any secondary fluid 120 and air trapped therein exits the secondary fluid port 145 via valves C1, C2 or exits the port connection 140 via valves D1, D2 of the first and second pump units 122, 124, then the secondary fluid 120 can return to the secondary fluid sump 106 while any trapped air can float up and escape out of the secondary fluid 120 in the secondary fluid sump 106. In some implementations, as the secondary fluid 120 is drawn out of the primary pump 102, the inner liners 126 of the primary pump 102 may expand slightly due to reduce pressure by the secondary fluid 120.

The steps illustrated and discussed in FIGS. 11, 12, and 13 are then repeated until the secondary fluid 120 is removed from the secondary fluid chambers 132 of the first and second pump units 122, 124. In some implementations, the number of times that these purging steps are repeated is a predetermined number. In other implementations, a sensor (e.g., a liquid sensing probe) may be present in the first and second pump units 122, 124 to indicate when the first and second pump units 122, 124 are substantially free of secondary fluid 120; upon such detection, the sensor may automatically alert a processing controller of the pump system 100 and stop these steps of the purging operation. In some other implementations, a sensor may be present in the secondary fluid sump 106, for example, to alert the processing controller of the pump system 100 that the secondary fluid sump 106 volume has been restored to a desired volume that indicates the primary pump is substantially empty of secondary fluid 120.

When the repetition of the steps in FIGS. 11, 12, and 13 are completed, then the secondary fluid 120 has been completely removed or substantially removed from the primary pump 102. It will be appreciated that in some implementations, a trace amount of the secondary fluid 120 may remain in the first and second pump units 122, 124 of the primary pump 102. After the secondary fluid 120 is removed from the primary pump 102, the C1, C2, D1, D2, E1, and E2 valves are closed and the first and second pistons 112, 116 are moved back to P1, as shown in FIG. 14.

FIG. 15 illustrates a flow chart of some implementations of a purging operation method that may correspond to what was described above with respect to FIGS. 11-14

At 1502, the purging operation starts. In some implementations the purging operation automatically starts after a predetermined number of pumping operation cycles are complete, which is automated by a processing controlled of the pump system 100. In some other implementations, the purging operation may automatically start when a sensor detects a leak in the primary pump 102 and sends a signal to a processing controller of the pump system 100 to begin the purging operation. In yet some other implementations, the purging operation starts by a user-entered command to the pump system 100 to start the purging operation prior to replacing any portion of the first and second pump units 122, 124.

At 1504, the first and second pistons 112, 116 are moved to P2, as illustrated in FIG. 11. All C, D, and E valves are closed as the first and second pistons 112, 116 are moved to P2.

At 1506, valves C1, C2, D1, and D2 remain closed, and valves E1 and E2 are opened. Then, the first and second pistons 112, 116 are moved to P1, as illustrated in FIG. 12.

At 1508, valves E1 and E2 are closed, while valves C1 and C2 are opened.

At 1510, the first and second pistons are moved to P2, and at 1212, valves D1, D2 and/or valves C1, C2 are opened such that air can be pushed into the secondary fluid sump 106. FIG. 13 illustrates some implementations of steps 1508, 1510, and 1512.

At 1514, the steps of 1508-1512 are repeated for "n" times. The equation for "n" is "x−1," where "x" is the number of purging cycles required to empty the secondary fluid 120 to the secondary fluid sump 106, as indicated at 1516. When "n" is less than "x−1", then the purging operation proceeds from 1514 back to 1506. When "n" is greater than or equal to "x−1", then the purging operation proceeds from 1214 to 1218. Step 1214 indicates implementations where there is a predetermined number of purging cycles to perform the purging operation. As discussed previously, in some other implementations, the purging cycle of steps 1508-1512 may be repeated based on information collected from a sensor or some other parameter that indicates purging is complete.

At 1518, valves C1, C2, D1, D2, E1, and E1 are closed, and pistons 112, 116 are moved the P1, as illustrated in FIG. 14. At 1520, the purging operation is complete.

Figure 16:
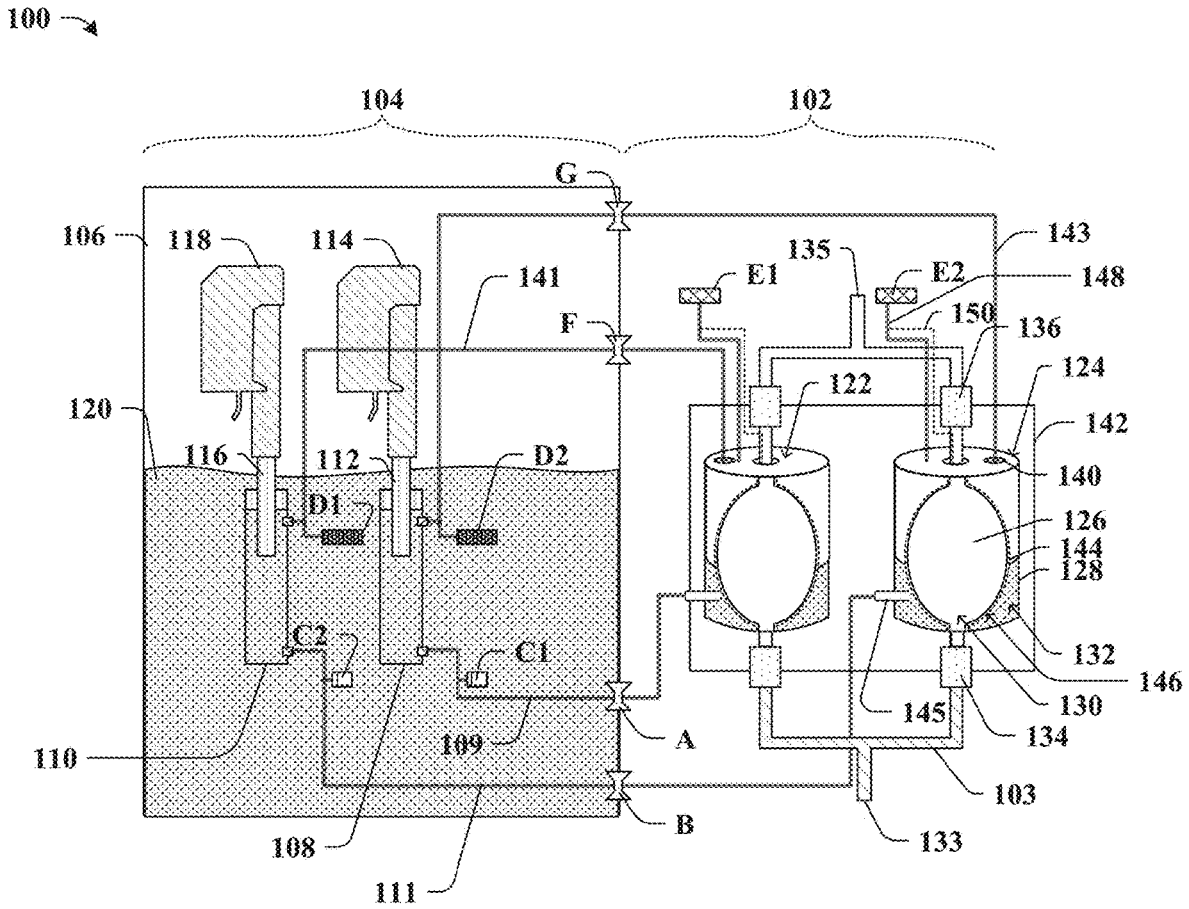
FIGS. 16 and 17 illustrate cross-sectional views of some implementations pump system at various moments in time during a priming operation as described herein.
Figure 17:
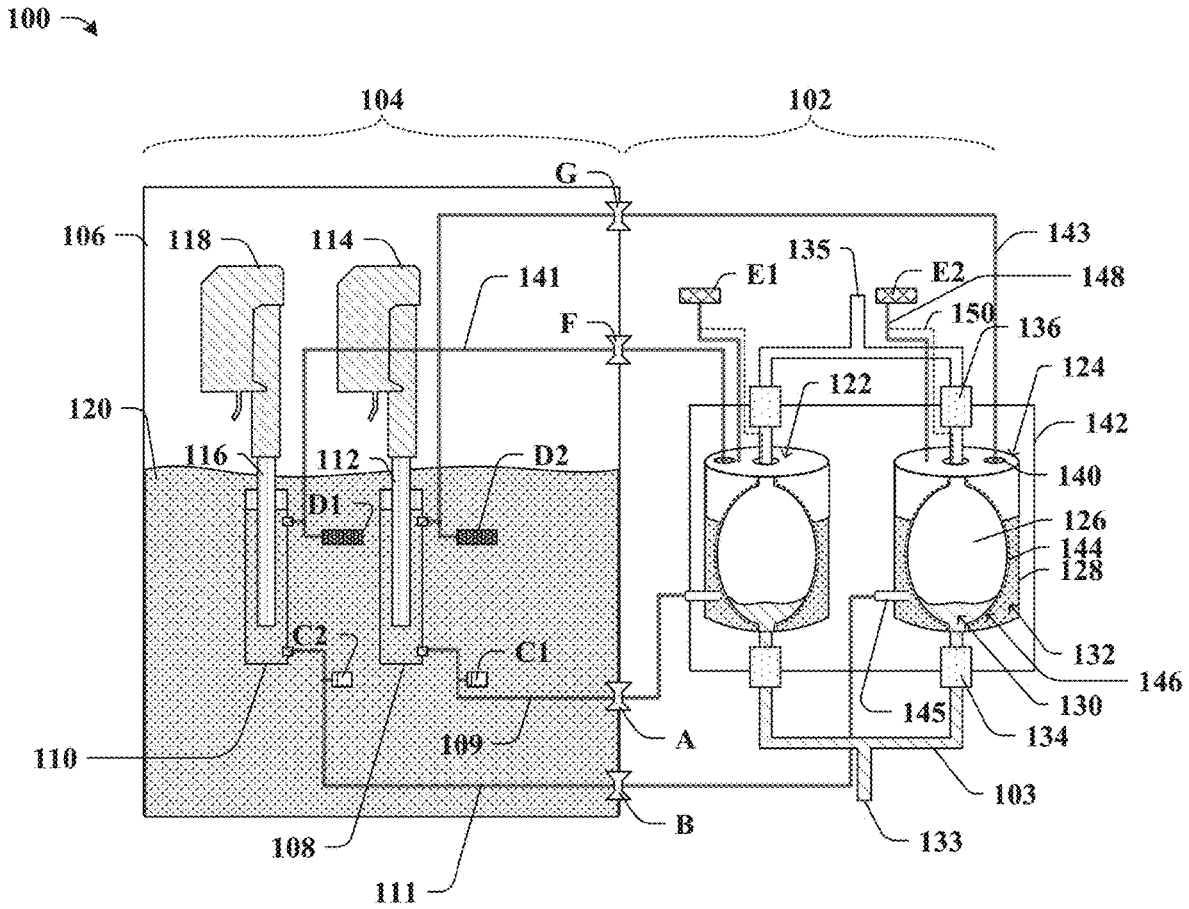
Figure 18:
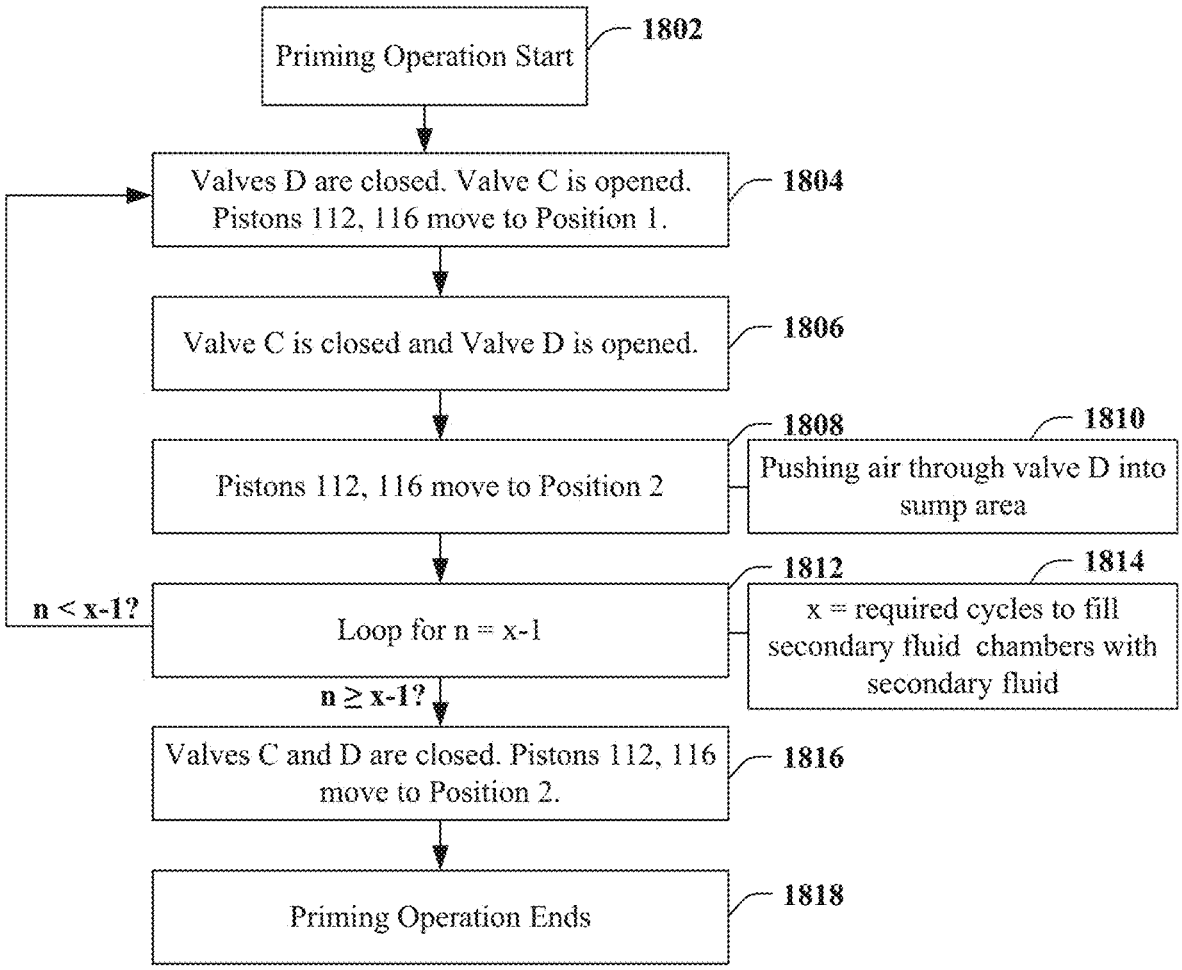
FIG. 18 illustrates a flow diagram of some implementations of performing a priming operation as described herein.

Referring additionally to FIGS. 16-18, a priming operation of the pump system 100 will be discussed. In some implementations, after the purging operation is performed, at least the inner liners 126 of the primary pump 102 are replaced. At least in implementations where the secondary fluid 120 is removed from the primary pump 102 from the purging operation, waste of and contamination by the secondary fluid 120 is prevented when accessing the primary pump 102. Once the new inner liners 126 and other parts of the primary pump 102 are connected to the pump system 100, the priming operation may begin if additional secondary fluid 120 is needed in the primary pump 102. In some implementations, the priming operation may automatically begin due to a sensor that detects that new parts of the primary pump 102 have been connected to the pumping system 100. In some other implementations, the priming operation starts by a user-entered command to the pump system 100 to start the priming operation. During the priming operation, the pump system 100 refills the secondary fluid chamber 132 of the first and second pump units 122, 124 of the primary pump 102 with the secondary fluid 120.

FIGS. 16 and 17 each schematically represent a moment in time of the pump system 100 during the priming operation, and FIG. 18 illustrates a flow chart of some implementations of the priming operation method that may correspond to FIGS. 16 and 17.

It will be appreciated that the priming operation may begin when the first and second pistons 112, 116 are at P1 and all the C1, C2, D1, D2, E1, and E2 valves are closed as shown in FIG. 14, for example. Then, as shown in FIG. 16, the C1, C2 valves are opened, while the D1, D2, E1, and E2 valves remain closed. At this moment, some secondary fluid 120 may enter the first and second piston chambers 108, 110 and/or the secondary fluid chambers 132 of the primary pump 102 through valves C1 and C2. In some implementations, air valves E1 and E2 are air inlet valves coupled to the secondary fluid chambers 132 and remain closed throughout the purging process. In some other implementations, air valves E1 and E2 are air outlet valves coupled to the intermediate chambers 146 and may remain opened or closed throughout the purging process. In yet other implementations, the air valves E1 and E2 may be completely omitted from pump systems 100 that utilize purging processes.

As shown in FIG. 17, the priming operation proceeds by closing valves C1 and C2, opening valves D1 and D2, and pushing the first and second pistons 112, 116 to P2. In particular, in some implementations, the valves D1, D2 open as valves C1, C2 close upon the pushing of the first and second pistons 112, 116 to P2. As the first and second pistons 112, 116 are pushed to P2, the secondary fluid 120 is forced into the secondary fluid chambers 130 of the primary pump 102, and air escapes the secondary fluid chambers 130 of the primary pump via valves D1 and D2. Like in the purging operation, at this time in the priming operation, the air exiting valves D1, D2 escapes the secondary fluid 120 by bubbling to the top of and escaping from the secondary fluid 120 in the secondary fluid sump 106. In some implementations, some of the secondary fluid 120 from the primary pump 102 also escapes back into the secondary fluid sump 106 via the valves D1 and D2.

The steps illustrated and discussed in FIGS. 16 and 17 are then repeated until the secondary fluid 120 fills the secondary fluid chambers 132 of the first and second pump units 122, 124. In some implementations, the number of times that these priming steps are repeated is a predetermined number. In other implementations, a sensor may be present in the first and second pump units 122, 124 to indicate when the first and second pump units 122, 124 are filled with the secondary fluid 120 such that the inner liners 126 are in a compressed state; upon such detection, the sensor may automatically alert a processing controller of the pump system 100 and stop these steps of the priming operation. In some other implementations, a sensor may be present in the secondary fluid sump 106, for example, to alert the processing controller of the pump system 100 that the secondary fluid sump 106 volume has been reduced to a desired volume that indicates the primary pump is substantially filled with secondary fluid 120.

When the repetition of the steps in FIGS. 16 and 17 are completed, then the secondary fluid 120 has filled the primary pump 102 and any air has escaped the primary pump 102. Then, the valves C1, C2, D1, D2 are closed, while the pistons 112, 116 are moved back to P2. The pump system 100 is then ready for pumping primary fluid 103 through the primary pump 102. The state of the pump system 100 at the end of priming is illustrated by, for example, FIG. 7.

FIG. 18 illustrates a flow chart of some implementations of a priming operation method that may correspond to what was described above with respect to FIGS. 16 and 17.

At 1802, the priming operation starts. As described above with respect to FIG. 16, in some implementations the priming operation automatically starts after a sensor sends a signal to a processing controller of the pump system 100 that new inner liners 126 have been connected to the pump system 100. In some other implementations, the priming operation starts upon a user-entered command to the pump system 100 to start the priming operation.

At 1804, valves D1 and D2 are closed; valves C1 and C2 are opened; and the first and second pistons 112, 116 are moved to P1. This step 1804 may correspond to what is illustrated in FIG. 16. As described previously, the state of air valves E1, E2 depends upon which chambers the air valves E1, E2 are coupled to. In yet other implementations, air valves E1, E2 are omitted completely from the pump system 100.

At 1806, valves C1 and C2 are closed, and valves D1 and D2 are opened.

At 1808, the first and second pistons are moved to P2, and at 1810, air is pushed into the secondary fluid sump 106 via the valves D1 and D2. The steps of 1806, 1808, and 1810 may correspond to what is illustrated in FIG. 17. Further, in some implementations, the steps at 1806 and 1808 may be conducted somewhat simultaneously, as the movement of pistons 112, 116 to P2 may result in the closure of valves C1, C2 and the opening of valves D1, D2.

At 1812, the steps of 1804-1810 are repeated for "n" times. The equation for "n" is "x−1," where "x" is the number of priming cycles required to fill the secondary fluid chambers 132 of the primary pump 102 with the secondary fluid 120, as described at 1814. When "n" is less than "x−1", then the priming operation proceeds from 1812 back to 1804. When "n" is greater than or equal to "x−1", then the priming operation proceeds from 1812 to 1816. Step 1812 indicates implementations where there is a predetermined number of priming cycles to perform the purging operation. As discussed previously, in some other implementations, the priming cycle of steps 1804-1812 may be repeated based on information collected from a sensor or some other parameter that indicates purging is complete.

At 1816, valves C1, C2, D1, D2, E1, and E2 are closed, while the first and second pistons 112, 116 are moved to P2. FIG. 7 may correspond to some implementations of step 1816. At 1818, the priming operation is complete.

Figure 19:
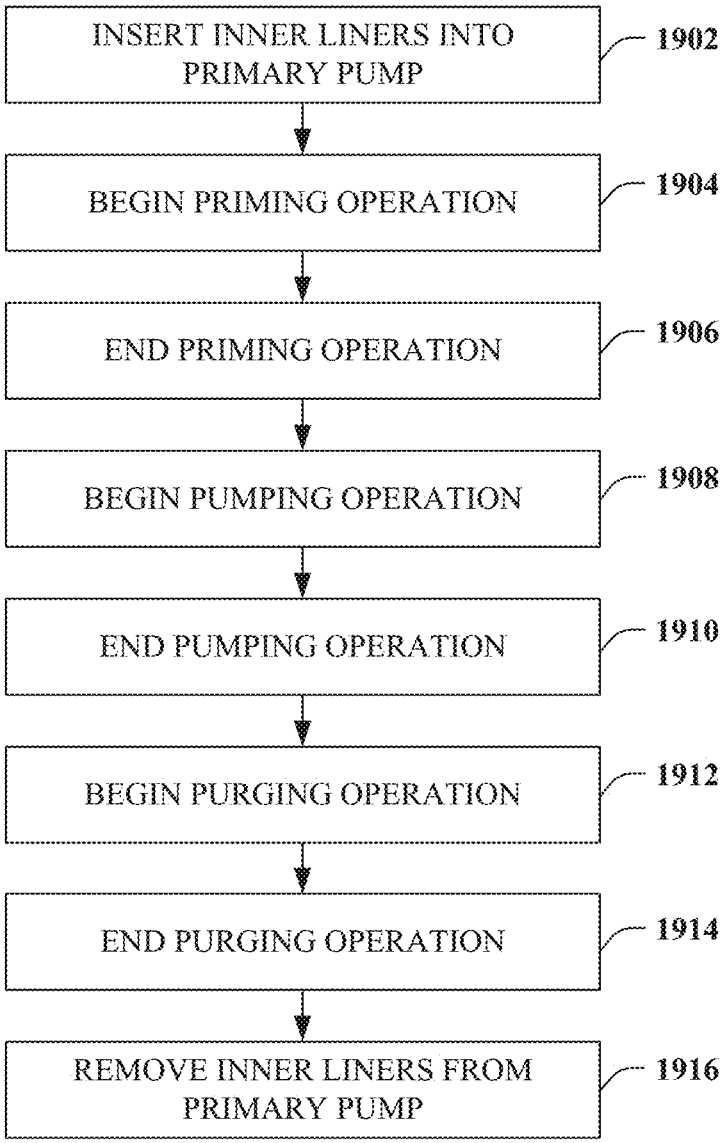
FIG. 19 illustrates a flow diagram of some implementations of operating a pump system and replacing an inner liner of the pump system as described herein.

Referring additionally to FIG. 19, FIG. 19 illustrates a flow diagram of some implementations of the overall use of the pump system 100 described herein.

At 1902, inner liners 126 are inserted into the primary pump 102. In some implementations, only the inner liners 126 are inserted into the primary pump 102 as shown in the clamshell design of FIGS. 4A-E. In other implementations, an entire cartridge design of FIG. 3 is used for the first and second pump units 122, 124 of the primary pump 102, and thus, the entire cartridge design, which includes inner liners 126, is inserted into the primary pump 102.

At 1904, a priming operation begins. FIG. 18 illustrates a flow diagram of some implementations of a priming operation. In some implementations, where the secondary fluid 120 is already in the first and second pump units 122, 124 upon inserting the inner liners 126, the priming operation at 1904 may be skipped. For example, the priming operation may not be necessary before every pumping operation when using the clamshell design. In other implementations, the priming operation may be conducted as necessary when using a clamshell design to restore any inadvertent loss in secondary fluid 120 in the clamshell design.

At 1906, the priming operation concludes such that the secondary fluid chambers 132 of the primary pump 102 are filled with secondary fluid 120.

At 1908, a pumping operation is performed to pump a primary fluid 103 through the primary fluid chambers 130 of the inner liners 126 and a secondary fluid 120 through secondary fluid chambers 132 of the primary pump 102. FIG. 8 illustrates a flow diagram of some implementations of a pumping operation.

At 1910, the pumping operation is concluded.

At 1912, a purging operation is performed to remove the secondary fluid 120 from the primary pump 102. FIG. 12 illustrates a flow diagram of some implementations of a purging operation. In some implementations, the secondary fluid chamber 132 is not exposed when removing or inserting an inner liner 126, the purging operation 1912 may be skipped.

At 1914, the purging operation concludes.

At 1916, the inner liners 126 are removed from the primary pump 102, and the process outlined in FIG. 19 may then be repeated to pump new primary fluid 103 through a new inner liner 126 in the primary pump 102.

Referring additionally to FIGS. 20-23, a priming operation of the pump system 100 will be discussed when the valves C1, C2, D1, and D2 are pressure relief valves. By using pressure relief valves for valves C1, C2, D1, and D2, electronic controls and components can be reduced. Further, the valves C1, C2, D1, and D2 are submerged in the secondary fluid 120 of the secondary fluid sump 106, and thus, are difficult to access. Because pressure relief valves typically require less maintenance than electronic valves, the pressure relief valves C1, C2, D1, and D2 improve the ease of maintenance and overall lifetime of the pump system 100. Further, in some such implementations, the valves E1 and E2 are coupled to the intermediate chambers 146 and function as are non-return valves (i.e., one-way, air outlet valves) that allow air out of the intermediate chambers 146 of the primary pump 102. In other implementations, the air valves E1, E2 are omitted. Nevertheless, regardless of the design and/or presence of the air valves E1, E2, during the priming process, air does not enter any chambers of the first and second pump units.

Because the clamshell design does not require a purging process, the pressure relief valve implementation is especially well-suited for when the clamshell design of FIG. 4A is used for the first and second pump units 122, 124. In some other implementations, additional valving that is electronically controlled may be coupled to the piston chambers 108, 110 and the first and second pump units 122, 124 to carry out a purging process as needed, while the pressure relief valves C1, C2, D1, D2 can be reliably used for more-routine priming operations.

As discussed previously, the valves C1, C2, D1, and D2 remain closed during pumping, but are opened in purging and priming operations. The pump system 100 can create various pressure differences in the secondary fluid 120 at the valves C1, C2, D1, and D2 to appropriately open and close the valves C1, C2, D1, and D2. Thus, the priming and purging operations of a pump system 100 comprising pressure relief valves C1, C2, D1, and D2 are slightly different than a pump system 100 comprising electronic-controlled valves C1, C2, D1, and D2.

In some implementations, the pressure relief valves C1, C2 are opened upon sensing a real-time pressure that is less than a low-pressure activation value. In some implementations, the low-pressure activation value may be equal to, for example, less than 1 bar, less than 0.8 bar, or less than 0.5 bar. The low-pressure activation value may be low enough to activate the valves C1, C2 without causing cavitation in the tubing of the pump system 100. In some implementations, the pressure relief valves D1, D2 are opened upon sensing a real-time pressure that is greater than a high-pressure activation value. In some implementations, the high-pressure activation value may be equal to, for example, greater than about 4 bar, greater than about 5 bar, or greater than 5.5 bar. During the pumping operation, the first and second pistons 112, 116 move between the first position P1 and the second position P2, and the pump system 100 operates at a pressure between the low-pressure activation value and the high-pressure activation value. The pressure relief valve design for C1, C2, D1, D2 also provides pump pressure protection to the pump system 100 without subjecting the primary fluid 103 to the potential shear forces that may occur within the pressure relief valves. Instead, only the secondary fluid 120 is exposed to the pressure relief valves C1, C2, D1, D2. In other words, the pump system 100 may utilize pressure relief valves C1, C2, D1, D2 and have pump pressure protection therefrom without damaging the primary fluid 103 from high pressures and cavitation, without causing an unwanted increase in primary fluid 103 volume, and without creating cleanability and sterility challenges that may be associated with pressure relief valves in contact with the primary fluid 103.

Figure 20:
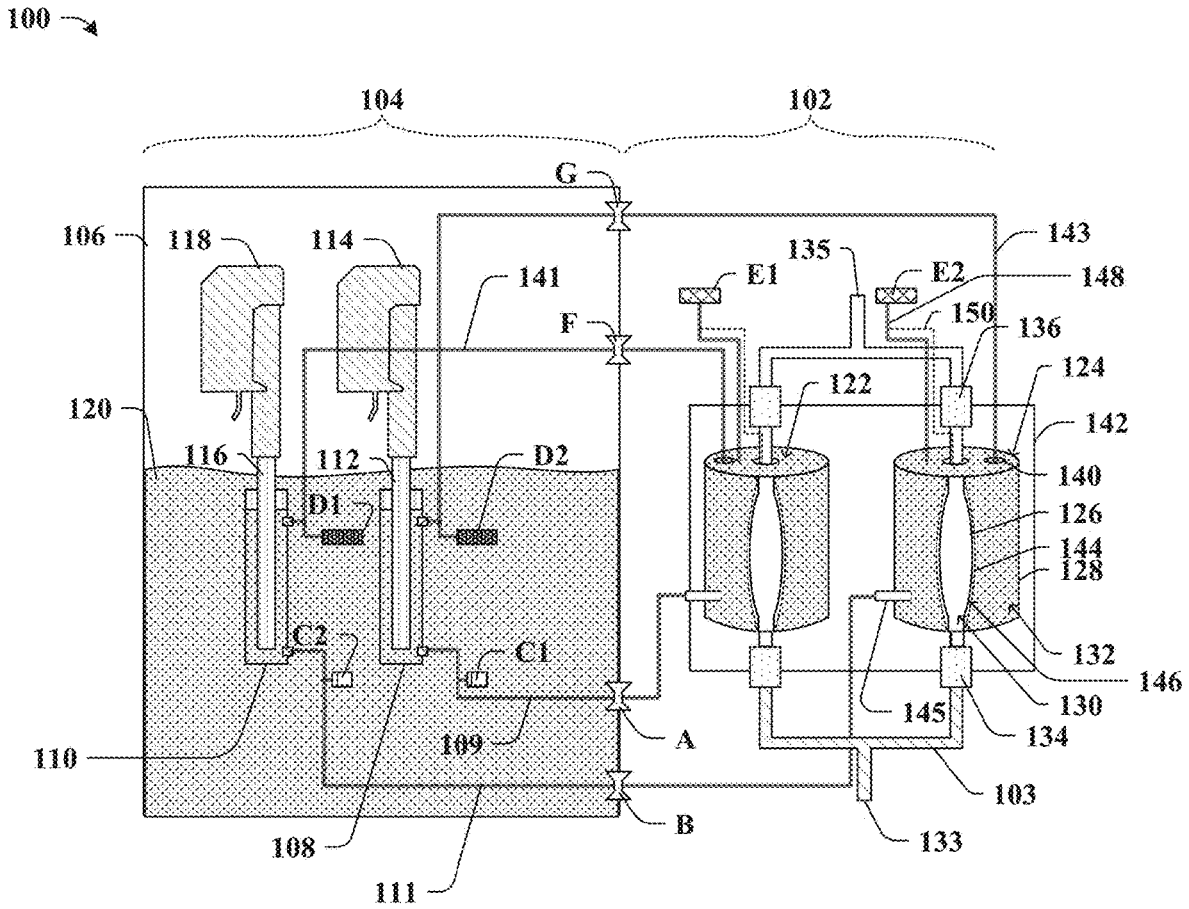
FIGS. 20, 21, and 22 illustrate cross-sectional views of some implementations pump system at various moments in time during a priming operation when the pump system comprises pressure relief valves as described herein.
Figure 21:
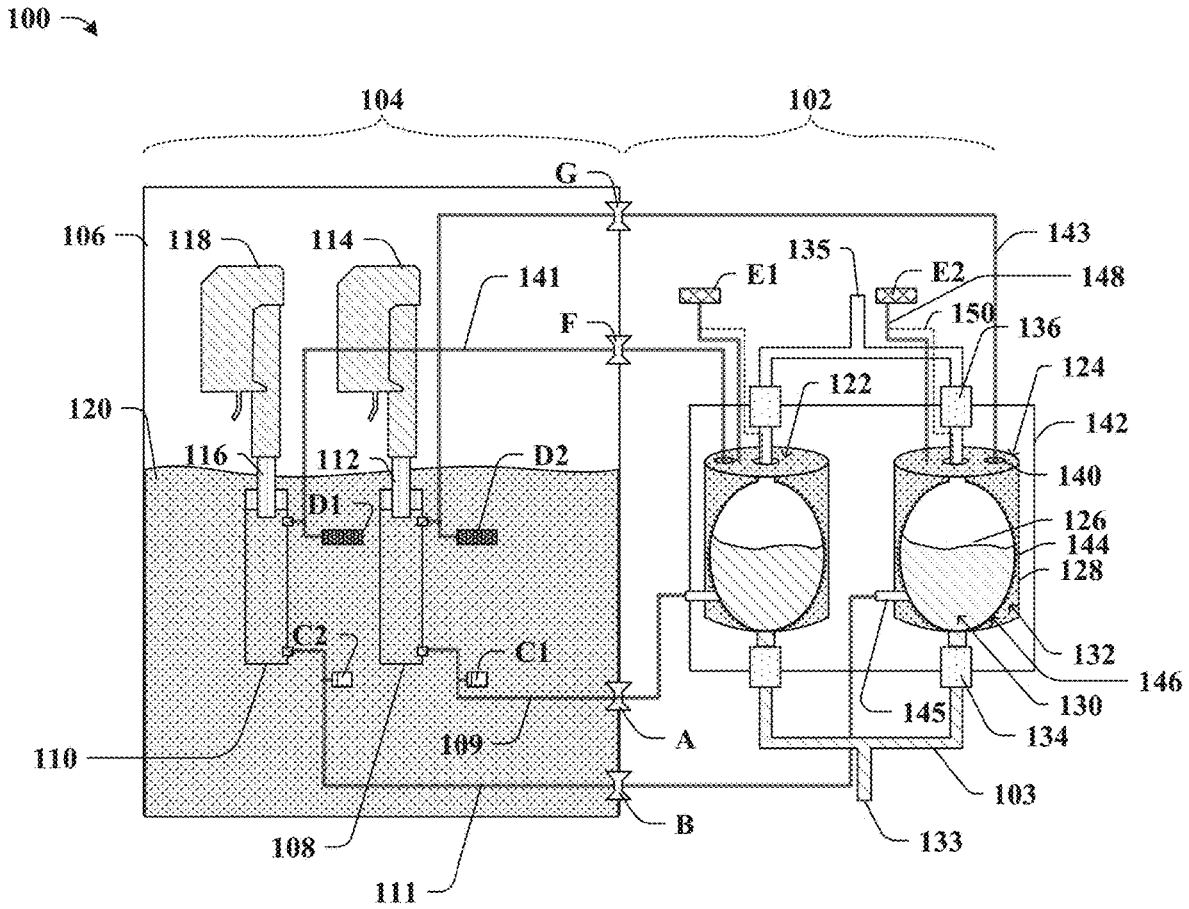
Figure 22:
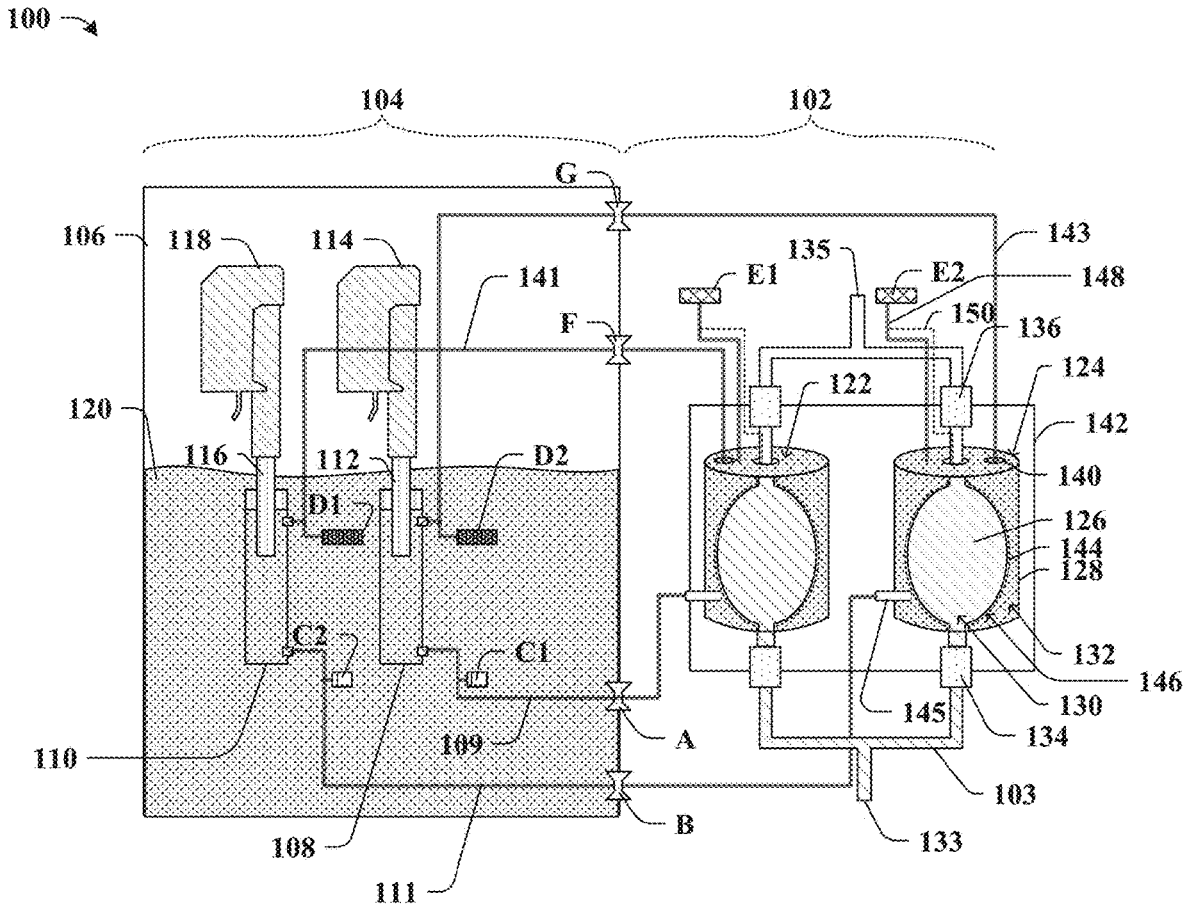
Figure 23:
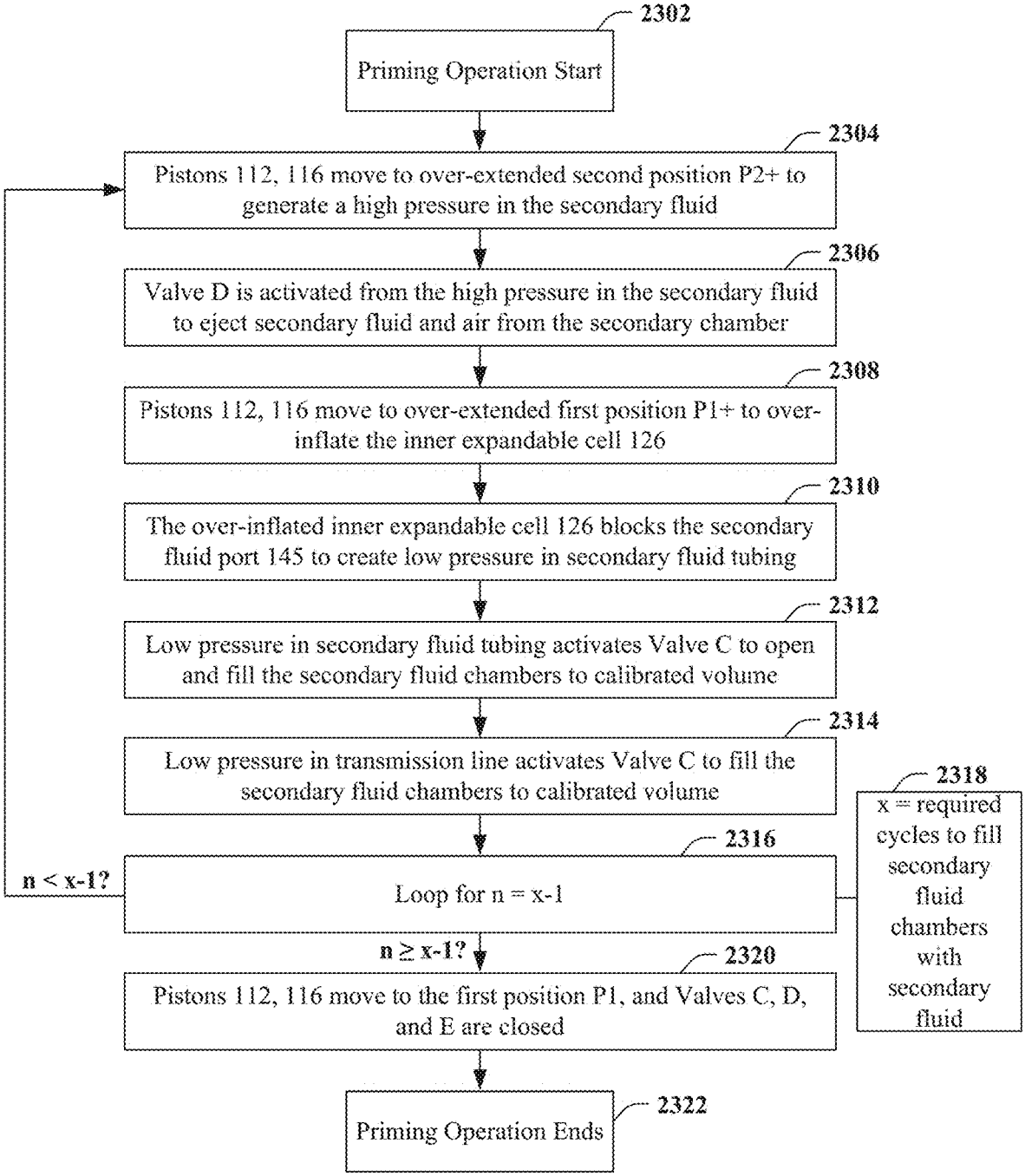
FIG. 23 illustrates a flow diagram of some implementations of performing a priming operation when the pump system comprises pressure relief valves as described herein.

FIGS. 20, 21, and 22 each schematically represent a moment in time of the pump system 100 during the priming operation when the valves C1, C2, D1, and D2 are pressure relief valves, and FIG. 23 illustrates a flow chart of some implementations of the priming operation method that may correspond to FIGS. 20-22.

In some implementations, the priming process begins once a new inner liner 126 is loaded into each of the first and second pump units 122, 124. Depending on the design of the first and second pump units 122, 124, the entire first and second pump units 122, 124 may be replaced as cartridge or the inner liners 126 may be selectively removed from the first and second pump units 122, 124. In some implementations, after replacement of at least the inner liners 126, the secondary fluid chambers 132 of the first and second pump units 122, 124 may contain substantially no secondary fluid 120 or may contain a reduced amount of secondary fluid 120. In some such implementations, the priming operation can selectively open and close the valves C1, C2, D1, and D2 to add secondary fluid 120 to and remove air from the secondary fluid chambers 132 of the primary pump 102 to prepare the primary pump 102 for a pumping operation.

It will be appreciated that in some implementations, the priming operation may begin when the first and second pistons 112, 116 are at P1 and all the C1, C2, D1, D2, E1, and E2 valves are closed as shown in FIG. 14, for example. Then, as shown in FIG. 20, the first and second pistons 112, 116 are moved to the over-extended second position P2+ to push secondary fluid 120 into the secondary fluid chambers 132 of the primary pump 102. Because the first and second pistons 112, 116 in the over-extended second position P2+, a high pressure in the secondary fluid 120 is generated by over compressing the secondary fluid 120 and inner liners 126. This high pressure in the secondary fluid activates pressure relief valves D1, D2 to open. The opened pressure relief valves D1, D2 eject secondary fluid 120 and any entrapped air from the piston chambers 108, 110 and/or the secondary fluid chambers 132 of the primary pump 102. The ejected secondary fluid 120 and air from pressure relief valves D1, D2 enter the secondary fluid sump 106.

At FIG. 21, the first and second pistons 112, 116 are then moved to the over-extended first position P1+ to remove enough secondary fluid 120 from the secondary fluid chambers 132 of the primary pump 102 such that the inner liners 126 over-inflate and block the secondary fluid port 145. In some implementations that comprise an intermediate liner (e.g., 144 of FIG. 3), it may be the intermediate liner that directly contacts and blocks the secondary fluid port 145.

By blocking the secondary fluid port 145, a low pressure is created in the first and second tubing 109, 111 which activates pressure relief valves C1 and C2 to open while the pressure relief valves D1 and D2 close. When opened, the pressure relief valves C1 and C2 allow secondary fluid 120 to enter the piston chambers 108, 110. In some implementations, during the over-inflation of the inner liners 126, at least some of the primary fluid 103 is drawn into the primary fluid chamber 130 of each inner liner 126 from the primary fluid inlet 133. The inner liner 126 and/or an intermediate liner (e.g., 144 of FIG. 3) arranged between the inner liner 126 and the outer liner 128 comprises a material that can withstand this over-inflation pressure and contact with the secondary fluid port 145. The priming operation that causes such over-inflation and contact with the secondary fluid port 145 by the inner liner 126 and/or an intermediate liner (e.g., 144 of FIG. 3) occurs before a pumping operation. Thus, the material for the inner liner 126 and/or an intermediate liner is chosen such that it is durable enough to survive these processes without tearing.

In some other implementations, the secondary fluid port 145 may comprise an automated solenoid valve or some other electronic valve to open and close the secondary fluid port 145 as needed during the priming operation. In some such other implementations, additional electronic signals and processors are required to conduct the priming operation, but over-inflation of and thus, damage to the inner liner 126 and/or an intermediate liner is mitigated.

The steps illustrated and discussed in FIGS. 20 and 21 are then repeated until the secondary fluid 120 fills the secondary fluid chambers 132 of the first and second pump units 122, 124. As mentioned previously, the number of times that the steps in FIGS. 20 and 21 are repeated may be based on a predetermined number, a sensor signal, or some other parameter that indicates the primary pump is substantially filled of secondary fluid 120.

As shown in FIG. 22, when the repetition of the steps in FIGS. 20 and 21 are completed, then the secondary fluid 120 has filled the primary pump 102 and any air has escaped the primary pump 102. The first and second pistons 112, 116 may be moved to the first position P1 to return and stabilize the pressure of the pump system 100, thereby closing the pressure relief valves C1, C2, D1, and D2. At FIG. 22, the inner liners 126 are no longer over-inflated and thus, no longer block the secondary fluid port 145. The pump system 100 may then be ready for a pumping operation. Because the first and second pistons 112, 116 do not move to the over-extended first position P1+ or the second position P2+ during pumping, the pump system 100 pressure does not drop below the low-pressure activation value or rise above the high-pressure activation value. The inner liners 126 also do not over-inflate during pumping when operating at a pressure between the low-pressure activation value and the high-pressure activation value. Therefore, the pressure relief valves C1, C2, D1, and D2 remain closed and the secondary fluid port 145 remains unblocked during the pumping operation.

FIG. 23 illustrates a flow chart of some implementations of a priming operation method that may correspond to what was described above with respect to FIGS. 20-22.

At 2302, the priming operation starts.

At 2304, the pistons 112, 116 move to the over-extended second position P2+ to generate a high pressure in the secondary fluid 120.

At 2306, valve D (e.g., pressure relief valves D1, D2) is activated from the high pressure in the secondary fluid 120 to eject secondary fluid and air from the secondary fluid chambers 132.

At 2308, the pistons 112, 116 move to the over-extended first position P1+ to over-inflate the inner liners 126.

At 2310, the over-inflated inner liner 126 blocks the secondary fluid port 145 to create low pressure in tubing 109, 111.

At 2312, low pressure in the tubing 109, 111 activates the valve C (e.g., valves C1, C2) to open and fill the secondary fluid chambers 132 to a calibrated volume.

At 2316, the steps of 2304-2314 are repeated for "n" times. The equation for "n" is "x−1," where "x" is the number of priming cycles required to fill the secondary fluid chambers 132 of the primary pump 102 with sufficient amount of secondary fluid 120, as indicated at 2318. When "n" is less than "x−1", then the priming operation proceeds from 2316 back to 2304. When "n" is greater than or equal to "x−1", then the priming operation proceeds from 2316 to 2320. Step 2316 indicates implementations where there is a predetermined number of purging cycles to perform the purging operation. As discussed previously, in some other implementations, the purging cycle of steps 2304-2314 may be repeated based on information collected from a sensor or some other parameter that indicates priming is complete.

At 2320, the first and second positions 112, 116 are moved to the first position P1, pressure of the secondary fluid 120 is restored to a value between the low-pressure activation value and the high-pressure activation value, and thus, the valves C1, C2, D1, D2, E1, and E2 are closed. Then, the priming operation ends at 2322.

Additionally, in some implementations, the pump system 100 can comprise an overpressure control such as a spring-loaded relief valve. The relief valve can be set to a predetermined pressure that is greater than the high-pressure activation value but less than a pressure that would damage the pumping system. When activated, the relief valve can direct secondary fluid 120 to a recirculation supply/source such as the secondary fluid sump 106. Further, in some implementations, the valve may be activated by a pressure transducer of otherwise electrical control.

Moreover, the word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure. In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

The implementations have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

What is claimed is:

1. A pump system, comprising:

a primary pump that pumps a primary fluid, the primary pump comprising a first pump unit comprising:

a first inner liner that is expandable, an interior of which defines a first primary fluid chamber, the first primary fluid chamber comprising an inlet and an outlet; and a first outer liner disposed around the first inner liner, an interior of the first outer liner defining at least a portion of a first secondary fluid chamber;

a secondary pump that pumps a secondary fluid, the secondary pump in fluid communication with the first secondary fluid chamber to operably pump the secondary fluid into and out of the first secondary fluid chamber, resulting in the compression and expansion of the first inner liner;

a first valve disposed proximate the inlet of the first primary fluid chamber;

a second valve disposed proximate the outlet of the first primary fluid chamber, wherein the first and second valves, in combination, are configured to merely allow fluid flow in one direction through the first primary fluid chamber; and a third valve in fluid communication between the external atmosphere and the first secondary fluid chamber and/or between the external atmosphere and an intermediate chamber formed between an exterior of the first inner liner and interior of a flexible first intermediate liner disposed between the first inner liner and the first outer liner.

2. The system of claim 1, the primary pump comprising a second pump unit disposed in parallel with the first pump unit, the second pump unit comprising a second inner liner that is expandable, an interior of which defines a second primary fluid chamber, the second primary fluid chamber comprising an inlet and an outlet, and a second outer liner disposed around the second inner liner, an interior of the second outer liner defining at least a portion of a second secondary fluid chamber.

3. The system of claim 2, the first pump unit and the second pump unit operably pumping in a synchronous and phased operation with respect to each other.

4. The system of claim 1, the interior of the first outer liner and the exterior of the first inner liner defining the first secondary fluid chamber.

5. The system of claim 1, the first pump unit comprising the flexible first intermediate liner disposed between the first inner liner and the first outer liner.

6. The system of claim 5, the interior of the first outer liner and an exterior of the flexible first intermediate liner defining the first secondary fluid chamber, and the first inner liner fluidly sealed from contact with the secondary fluid, wherein the first outer liner and the flexible first intermediate liner are configured to be movable between an opened position and a closed position, wherein the first inner liner is sandwiched between the flexible first intermediate liner and the first outer liner in the closed position, wherein the first inner liner is removable from the flexible first intermediate liner in the opened position, and wherein the first outer liner and the flexible first intermediate liner fluidly seal the secondary fluid from contacting the first inner liner in the opened and closed positions.

7. The system of claim 1, comprising a secondary fluid sump in fluid communication with the secondary pump, the secondary fluid sump operably providing secondary fluid to the secondary pump.

8. The system of claim 7, the secondary fluid sump in fluid communication with the first secondary fluid chamber to receive secondary fluid from the first secondary fluid chamber.

9. The system of claim 7, comprising a fourth valve and a fifth valve, the fourth valve merely providing for fluid transfer between the first secondary fluid chamber and the secondary fluid sump, and the fifth valve merely providing for fluid transfer between the secondary fluid sump and other portions of the secondary pump.

10. The system of claim 1, the first and second valves comprising passive one-way valves or electronically controlled, actuated valves.

11. The system of claim 1, the secondary pump operably pumping a known amount of secondary fluid into and out of the first secondary fluid chamber resulting in a known amount of primary fluid pumped through the first primary fluid chamber.

12. The system of claim 1, the first inner liner selectably removable from the first pump unit.

13. The system of claim 1, the first pump unit selectably removable from the primary pump.

14. The system of claim 1, the first outer liner disposed in two halves that are selectably separable to access the first inner liner.

15. A pump system, comprising:

a primary pump that pumps a primary fluid, the primary pump comprising a first pump unit comprising:

a first inner liner that is expandable, an interior of which defines a first primary fluid chamber, the first primary fluid chamber comprising an inlet and an outlet; and a first outer liner disposed around the first inner liner, an interior of the first outer liner defining at least a portion of a first secondary fluid chamber;

a secondary pump that pumps a secondary fluid, the secondary pump in fluid communication with the first secondary fluid chamber to operably pump the secondary fluid into and out of the first secondary fluid chamber, resulting in the compression and expansion of the first inner liner;

a first valve disposed proximate the inlet of the first primary fluid chamber, and a second valve disposed proximate the outlet of the first primary fluid chamber, wherein the first and second valves, in combination, are configured to merely allow fluid flow in one direction through the first primary fluid chamber;

a secondary fluid sump in fluid communication with the secondary pump and the first secondary fluid chamber to receive secondary fluid from the first secondary fluid chamber, the secondary fluid sump containing the secondary fluid used by the secondary pump; and a third valve and a fourth valve respectively disposed in the secondary fluid contained by the secondary fluid sump and respectively disposed below a secondary fluid level in the secondary fluid sump, the third and fourth valves each being one-way valves. the third valve fluidly coupled with the first secondary fluid chamber and the secondary fluid sump to allow the secondary fluid to enter the secondary fluid sump, and the fourth valve fluidly coupled with the secondary fluid sump and other portions of the secondary pump to allow the secondary fluid to be drawn out of the secondary fluid sump.

16. The system of claim 15, the third valve comprising an electronically controlled one-way valve to selectively provide for fluid flow from the first secondary fluid chamber and into the secondary fluid sump, and the fourth valve comprising an electronically controlled one-way valve to selectively provide for fluid transfer out of the secondary fluid sump and into other portions of the secondary pump.

17. The system of claim 15, comprising a fifth valve in fluid communication between the external atmosphere and the first secondary fluid chamber, and/or between the external atmosphere and an intermediate chamber formed between an exterior of the first inner liner and interior of a flexible first intermediate liner disposed between the first inner liner and the first outer liner.

18. The pump system of claim 15, wherein the third and fourth valves are completely submerged within the secondary fluid contained in the secondary fluid sump.

19. A pump system, comprising:

a primary pump that pumps a primary fluid, the primary pump comprising a first pump unit and a second pump unit, respective pump units comprising:

an inner liner that is expandable, an interior of which defines a primary fluid chamber, the primary fluid chamber comprising an inlet and an outlet;

an outer liner disposed around the inner liner, an interior of the outer liner defining at least a portion of a secondary fluid chamber, the secondary fluid chamber comprising a first fluid port and a second fluid port; and a first valve disposed proximate the primary fluid chamber inlet, and a second valve disposed proximate the primary fluid chamber outlet, wherein the first and second valves, in combination, are configured to merely allow fluid flow in one direction through the primary fluid chamber;

a secondary pump that pumps a secondary fluid in a cyclical flow path, the secondary pump comprising a dual chamber piston pump that is in fluid communication with the respective secondary fluid chambers of the first and second pump units to operably pump the secondary fluid into the respective secondary fluid chambers via the first fluid port and out of the respective secondary fluid chambers via the second fluid port, resulting in the compression and expansion of the respective inner liners of the first and second pump units; and a secondary fluid sump in fluid communication with the secondary pump and in fluid communication with the respective secondary fluid chamber to receive secondary fluid from the respective secondary fluid chamber, and the secondary fluid sump operably providing secondary fluid to the secondary pump;

wherein the first pump unit and second pump unit operably pump in a synchronous and phased operation with respect to each other.

20. The pump system of claim 19, wherein the dual chamber piston pump comprises a first piston chamber in fluid communication with at least one of the secondary fluid chambers, wherein the first piston chamber is fully submerged in the secondary fluid of the secondary fluid sump.

* * * * *